US010580603B2

(12) United States Patent
Kozai et al.

(10) Patent No.: US 10,580,603 B2
(45) Date of Patent: Mar. 3, 2020

(54) POWER SWITCHGEAR

(71) Applicant: OMRON CORPORATION, Kyoto-shi, Kyoto (JP)

(72) Inventors: Yuji Kozai, Kumamoto (JP); Natsumi Oyama, Yamaga (JP); Koichiro Matsushima, Kikuchi-gun (JP); Daisuke Ohtsubo, Yamaga (JP)

(73) Assignee: OMRON Corporation, Kyoto-shi (JP)

( * ) Notice: Subject to any disclaimer, the term of this patent is extended or adjusted under 35 U.S.C. 154(b) by 161 days.

(21) Appl. No.: 15/755,155

(22) PCT Filed: Jul. 28, 2016

(86) PCT No.: PCT/JP2016/072217

§ 371 (c)(1),
(2) Date: Feb. 26, 2018

(87) PCT Pub. No.: WO2017/145403

PCT Pub. Date: Aug. 31, 2017

(65) Prior Publication Data

US 2018/0240630 A1 Aug. 23, 2018

(30) Foreign Application Priority Data

Feb. 23, 2016 (JP) ..... 2016-031898

(51) Int. Cl.
*H01H 50/14* (2006.01)
*H01H 50/02* (2006.01)
(Continued)

(52) U.S. Cl.
CPC ..... *H01H 50/14* (2013.01); *H01H 50/021* (2013.01); *H01H 50/04* (2013.01);
(Continued)

(58) Field of Classification Search
CPC ..... H01H 2050/049; H01H 2050/446; H01H 50/021; H01H 50/04; H01H 50/14;
(Continued)

(56) References Cited

U.S. PATENT DOCUMENTS 6,788,176 B2 * 9/2004 Schmelz ..... H01H 51/2227 335/124
7,659,800 B2 * 2/2010 Gruner ..... H01H 1/26 335/185

(Continued)

FOREIGN PATENT DOCUMENTS

CN 103229266 A 7/2013
CN 104465225 A 3/2015

(Continued)

OTHER PUBLICATIONS

An English translation of the International Search Report of PCT/JP2016/072217 dated Nov. 1, 2016.

(Continued)

*Primary Examiner* — Bernard Rojas
(74) *Attorney, Agent, or Firm* — Metrolex IP Law Group, PLLC

(57) ABSTRACT

A second yoke is disposed at a distance from a first yoke in a predetermined first direction. The movable unit is disposed between the first yoke and the second yoke. The movable unit is rotated by magnetic force from the first yoke and the second yoke to switch between a contact state and a non-contact state of a first contact and a second contact. The first conductive member has an extending portion extending in a second direction vertical to the first direction. The extending portion and a second conductive member are disposed at positions not overlapping with the relay body as viewed in a third direction vertical to the first direction and the second direction.

14 Claims, 20 Drawing Sheets

(51) Int. Cl.

| | |
|---|---|
| ***H01H 50/04*** | (2006.01) |
| ***H01H 50/36*** | (2006.01) |
| *H01H 50/56* | (2006.01) |
| *H01H 50/24* | (2006.01) |
| *H01H 50/44* | (2006.01) |

(52) U.S. Cl.
CPC ..... *H01H 50/36* (2013.01); *H01H 50/24* (2013.01); *H01H 50/44* (2013.01); *H01H 50/56* (2013.01); *H01H 2050/049* (2013.01); *H01H 2050/446* (2013.01)

(58) Field of Classification Search
CPC ..... H01H 50/24; H01H 50/36; H01H 50/44; H01H 50/56
See application file for complete search history.

(56) References Cited

U.S. PATENT DOCUMENTS

| | | | | |
|---|---|---|---|---|
| 8,330,564 | B2 * | 12/2012 | Miller | H01H 1/54 335/128 |
| 9,691,562 | B2 * | 6/2017 | Neuhaus | H01H 1/54 |
| 9,741,518 | B2 * | 8/2017 | Choi | H01H 50/36 |
| 2012/0126787 | A1 | 5/2012 | Shaw et al. | |
| 2014/0043120 | A1 | 2/2014 | Tanaka et al. | |
| 2015/0262764 | A1 | 9/2015 | Tsurusu et al. | |

FOREIGN PATENT DOCUMENTS

| | | | |
|---|---|---|---|
| JP | 2000-100303 | A | 4/2000 |
| JP | 2000-215775 | A | 8/2000 |
| JP | 2007-66807 | A | 3/2007 |
| JP | 2015-127996 | A | 7/2015 |
| JP | 5741679 | B1 | 7/2015 |

OTHER PUBLICATIONS

An English translation of the Written Opinion of PCT/JP2016/072217 dated Nov. 1, 2016.
The Chinese Office Action (CNOA) dated Sep. 29, 2018 in a counterpart Chinese patent application.

* cited by examiner (A)

(B)

(A)

(B)

(A)

(B)

(A)

(B)

(A)

(B)

POWER SWITCHGEAR

TECHNICAL FIELD

The present invention relates to a power switchgear.

BACKGROUND ART

A power switchgear is provided with a relay for switching electric power. For example, in a power switchgear mounted in a smart meter of Patent Document 1, a relay is switched between a connected state and a disconnected state so as to switch between supply and stop of electric power from a power grid of a power company to a user's building.

For example, the power switchgear has an external terminal connected to the power grid and an external terminal connected to electric wiring of the user's building. The relay has a pair of relay terminals, and these relay terminals are respectively connected to the external terminals described above.

PRIOR ART DOCUMENT

Patent Document

Patent Document 1: US2012/0126787 A1

SUMMARY OF THE INVENTION

Problems to be Solved by the Invention

For example, in the power switchgear, when the relay terminal is disposed away from the external terminal, the relay terminal and the external terminal are coupled via a conductive member. Alternatively, the relay terminal and the external terminal may be coupled to each other via the conductive member in order to attach an electric component such as a current transformer into the power switchgear. In a case where the relay terminal and the external terminal are coupled via the conductive member as described above, when a large current flows through the conductive member, a magnetic field generated by a current flowing through the conductive member might affect the operation of the relay.

An object of the present invention is to reduce an influence of a magnetic field generated from a conductive member on the operation of a relay in a power switchgear.

Means for Solving the Problem

A power switchgear according to one aspect includes a relay, a first external terminal, a second external terminal, a first conductive member, and a second conductive member. The relay includes a relay body, a first relay terminal, and a second relay terminal. The first relay terminal and the second relay terminal protrude from the relay body. The first external terminal is electrically connected to the first relay terminal. The second external terminal is electrically connected to the second relay terminal. The first conductive member couples the first external terminal and the first relay terminal. The second conductive member couples the second external terminal and the second relay terminal. The relay body has a first contact, a second contact, a coil, an iron core, a first yoke, a second yoke, and a movable unit. The first contact is electrically connected to the first relay terminal. The second contact is electrically connected to the second relay terminal. The iron core is inserted in the coil. The first yoke is connected to one end of the iron core. The second yoke is connected to the other end of the iron core and is disposed with a space in a predetermined first direction with respect to the first yoke. The movable unit is disposed between the first yoke and the second yoke. The movable unit is rotated by electromagnetic force from the first yoke and the second yoke to switch between a contact state and a non-contact state of the first contact and the second contact. The first conductive member has an extending portion extending in a second direction vertical to the first direction. The extending portion and the second conductive member are disposed at positions not overlapping with the relay body as viewed in a third direction vertical to the first direction and the second direction.

The inventor of the present invention has found that in a case where the first yoke and the second yoke are disposed with a space therebetween in the first direction and the movable unit is disposed between the first yoke and the second yoke in the relay, when the direction of the magnetic field generated from the first and second conductive members is close to parallel to the first direction between the first yoke and the second yoke, the operation of the movable unit is affected. Further, the present inventor of the present invention has found that it is in a case where the first and second conductive members extend in the second direction vertical to the first direction and the extending portion and the second conductive member are disposed at positions overlapping with the relay body as viewed in the third direction vertical to the first direction and the second direction, when the direction of the magnetic field generated by the first and second conductive members is close to parallel to the first direction between the first yoke and the second yoke.

Therefore, in the power switchgear according to the present aspect, the extending portion extending in the second direction in the first conductive member and the second conductive member are disposed at positions not overlapping with the relay body as viewed in the third direction. Thereby, as compared with the case where the extending portion and the second conductive member are disposed at positions overlapping with the relay body as viewed in the third direction, the direction of the magnetic field generated from the extending portion and the second conductive member between the first yoke and the second yoke can be made greatly different from the direction parallel to the first direction. It is thereby possible to reduce the influence of the magnetic field generated from the first and second conductive members on the operation of the relay.

The extending portion may be disposed at a position overlapping with the relay body as viewed in the first direction. In this case, the direction of the magnetic field generated from the extending portion between the first yoke and the second yoke can be made to be further greatly different from the direction parallel to the first direction. It is thereby possible to further reduce the influence of the magnetic field generated from the first conductive member on the operation of the relay.

The first conductive member may include a first extending portion, a second extending portion, and a connector. The first extending portion may be connected to the first external terminal and extend in the second direction. The second extending portion may be connected to the first relay terminal and extend in the second direction. The connector may connect the first extending portion and the second extending portion. At least one of the first extending portion and the second extending portion may be disposed at a position not overlapping with the relay body as viewed in the third direction.

In this case, the direction of the magnetic field generated from at least one of the first extending portion and the second extending portion between the first yoke and the second yoke can be made greatly different from the direction parallel to the first direction. It is thereby possible to reduce the influence of the magnetic field generated from the first conductive member on the operation of the relay.

Both of the first extending portion and the second extending portion may be disposed at positions not overlapping with the relay body as viewed in the third direction. In this case, the direction of the magnetic field generated from the first extending portion and the second extending portion between the first yoke and the second yoke can be made greatly different from the direction parallel to the first direction. It is thereby possible to further reduce the influence of the magnetic field generated from the first conductive member on the operation of the relay.

At least one of the first extending portion and the second extending portion may be disposed at a position overlapping with the relay body as viewed in the first direction. In this case, the direction of the magnetic field generated from at least one of the first extending portion and the second extending portion between the first yoke and the second yoke can be made further greatly different from the direction parallel to the first direction. It is thereby possible to further reduce the influence of the magnetic field generated from the first conductive member on the operation of the relay.

Both of the first extending portion and the second extending portion may be disposed at positions overlapping with the relay body as viewed in the first direction. In this case, the direction of the magnetic field generated from the first extending portion and the second extending portion between the first yoke and the second yoke can be made further greatly different from the direction parallel to the first direction. It is thereby possible to further reduce the influence of the magnetic field generated from the first conductive member on the operation of the relay.

A rotary shaft of the movable unit may extend in the second direction. That is, the extending portion may extend in the same direction as the rotary shaft of the movable unit.

The movable unit may have a permanent magnet. The extending portion may be disposed such that the direction of the magnetic field generated by the current flowing through the extending portion is inclined with respect to the third direction in the permanent magnet. In this case, the influence of the magnetic field generated from the extending portion on the permanent magnet of the movable unit can be reduced. It is thereby possible to reduce the influence of the magnetic field generated from the first conductive member on the operation of the relay.

The rotary shaft of the movable unit may extend in the third direction. That is, the extending portion may extend in a separating direction of the first yoke and the second yoke and in a direction vertical to the direction of the rotary shaft of the movable unit.

All portions included in the first conductive member and extending in the second direction may be disposed at a position not overlapping with the relay body as viewed in the third direction. In this case, the direction of the magnetic field generated from all the portions included in the first conductive member between the first yoke and the second yoke can be made greatly different from the direction parallel to the first direction. It is thereby possible to further reduce the influence of the magnetic field generated from the first conductive member on the operation of the relay.

The power switchgear may further include a current transformer attached to the extending portion.

In this case, the current flowing through the extending portion can be measured by the current transformer.

The extending portion may have a circular cross section. In this case, the current transformer can be easily attached to the extending portion.

The power switchgear may include a housing and a plurality of relays. The plurality of relays may be disposed on the housing. The extending portion may be disposed at a position not overlapping with all the relay bodies of the plurality of relays as viewed in the third direction.

In this case, it is possible to reduce the influence of the magnetic field generated from the first conductive member on the operation of the relay with respect to all the relays on the housing.

All the portions included in the respective first conductive members of the plurality of relays may be disposed at positions not overlapping with all the relay bodies of the plurality of relays as viewed in the third direction. In this case, it is possible to further reduce the influence of the magnetic field generated from the first conductive member on the operation of the relay with respect to all the relays on the housing.

Effect of the Invention

According to the present invention, it is possible to reduce the influence of the magnetic field generated from the conductive member on the operation of the relay in the power switchgear.

MODE FOR CARRYING OUT THE INVENTION

Figure 1:
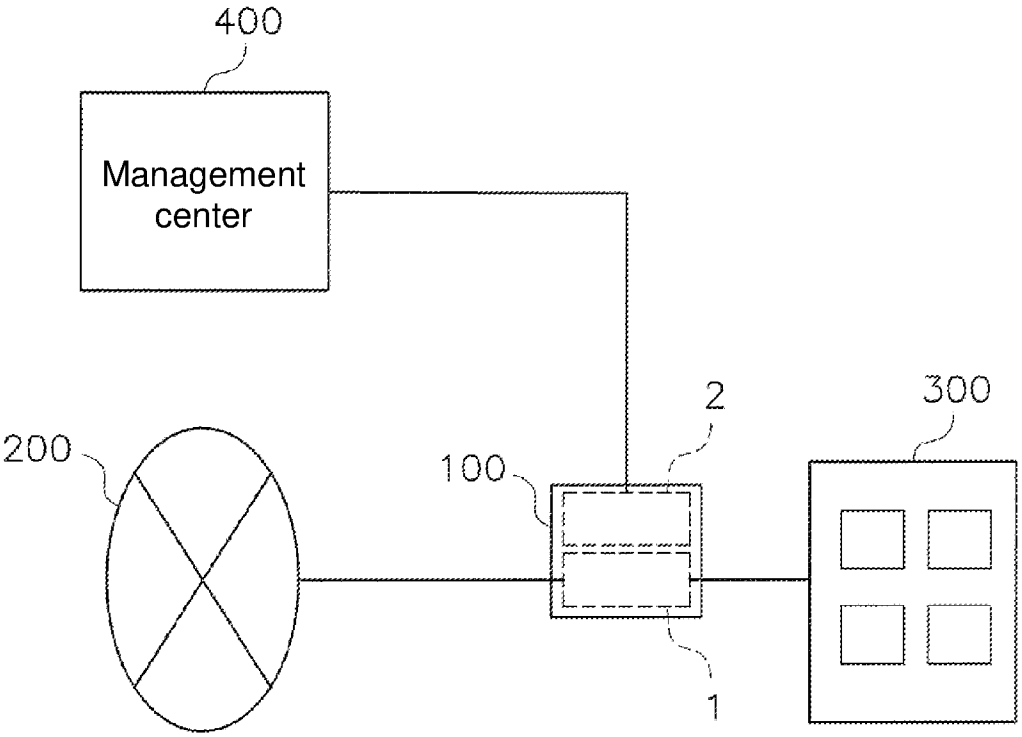
FIG. 1 is a schematic view showing a configuration of a smart meter on which a power switchgear according to an embodiment is mounted.

Hereinafter, relays according to embodiments will be described with reference to the drawings. FIG. 1 is a schematic view showing a configuration of a smart meter 100 on which a power switchgear 1 according to an embodiment is mounted. As shown in FIG. 1, the smart meter 100 is disposed between a power grid 200 of a power company and electric wiring of the user's building 300. The smart meter 100 includes the power switchgear 1 and a controller 2.

The power switchgear 1 switches between supply and stop of electric power from the power grid 200 of the power company to the user's building 300. The controller 2 communicates with a management center 400 of the power company and controls the power switchgear 1 based on a command signal from the management center 400. Further, the controller 2 measures an amount of electric power used in the user's building 300, and transmits information indicating the amount of electric power used to the management center 400.

For example, the management center 400 transmits a command signal to the controller 2 so as to stop the supply of electric power to the user's building 300 when the amount of electric power used reaches a predetermined specified value. The controller 2 stops the supply of electric power to the user's building 300 by switching the power switchgear 1 from a connected state to a disconnected state based on the command signal.

Figure 2:
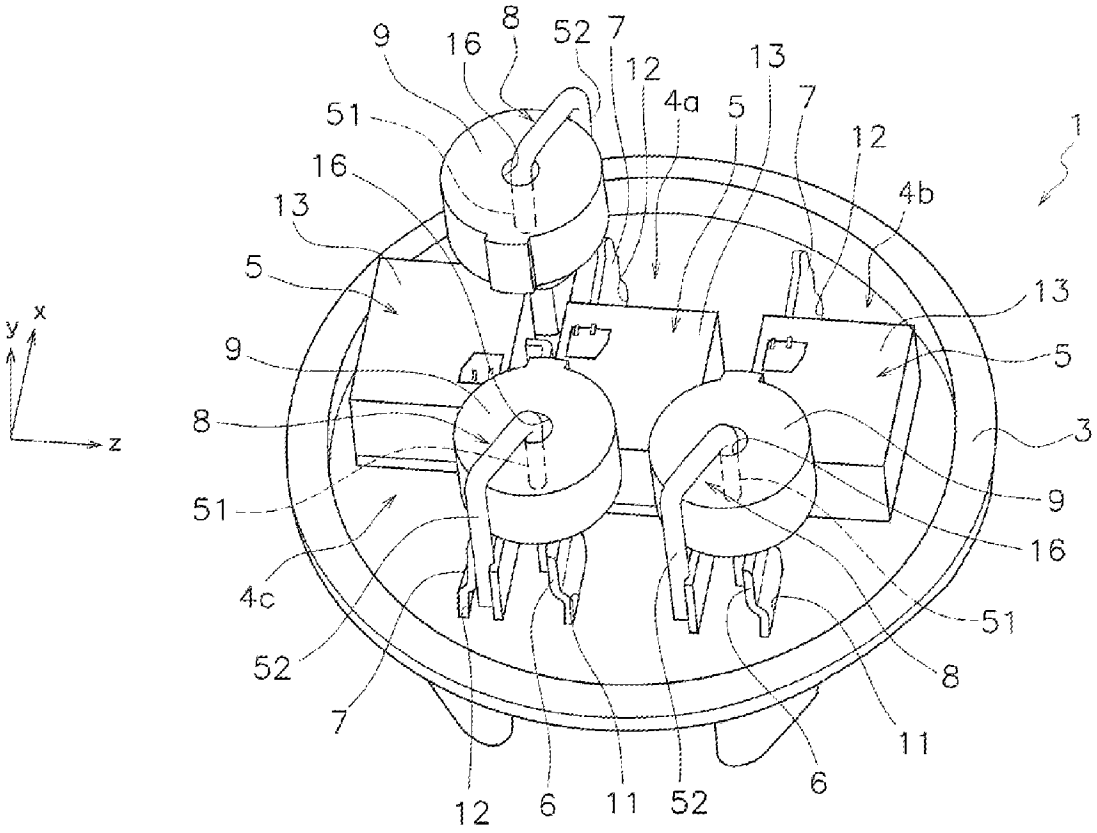
FIG. 2 is a perspective view of a power switchgear according to a first embodiment.

FIG. 2 is a perspective view of the power switchgear 1 according to the first embodiment. As shown in FIG. 2, the power switchgear 1 has a housing 3 and a plurality of relay units 4*a*, 4*b*, and 4*c*. The housing 3 has a substantially circular outer shape. The housing 3 supports the plurality of relay units 4*a*, 4*b*, and 4*c*. In detail, in the present embodiment, the power switchgear 1 includes a first relay unit 4*a*, a second relay unit 4*b*, and a third relay unit 4*c*.

Figure 4:
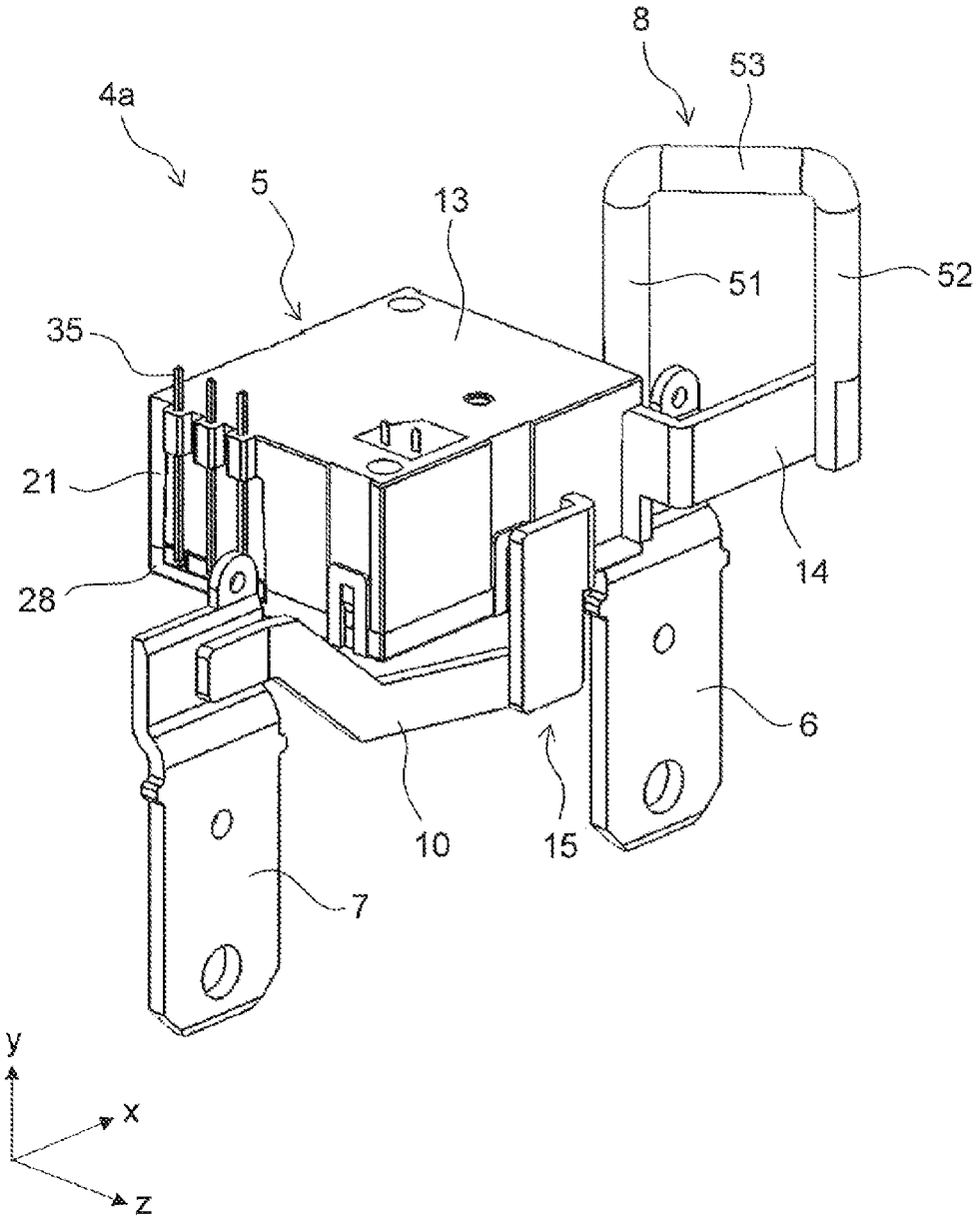
FIG. 4 is a perspective view of the first relay unit according to the first embodiment.

Each of the plurality of relay units 4*a*, 4*b*, and 4*c* includes a relay 5, a first external terminal 6, a second external terminal 7, a first conductive member 8, and a second conductive member 10 (cf. FIG. 4). The relay 5 is disposed on the housing 3.

The first external terminal 6 and the second external terminal 7 are disposed outside the relay 5.

The housing 3 is provided with a plurality of first openings 11 and a plurality of second openings 12. The first external terminal 6 is provided so as to protrude from the first opening 11 to the outside of the housing 3. The second external terminal 7 is provided so as to protrude from the second opening 12 to the outside of the housing 3. The relay 5 is disposed between the first opening 11 and the second opening 12.

Figure 3:
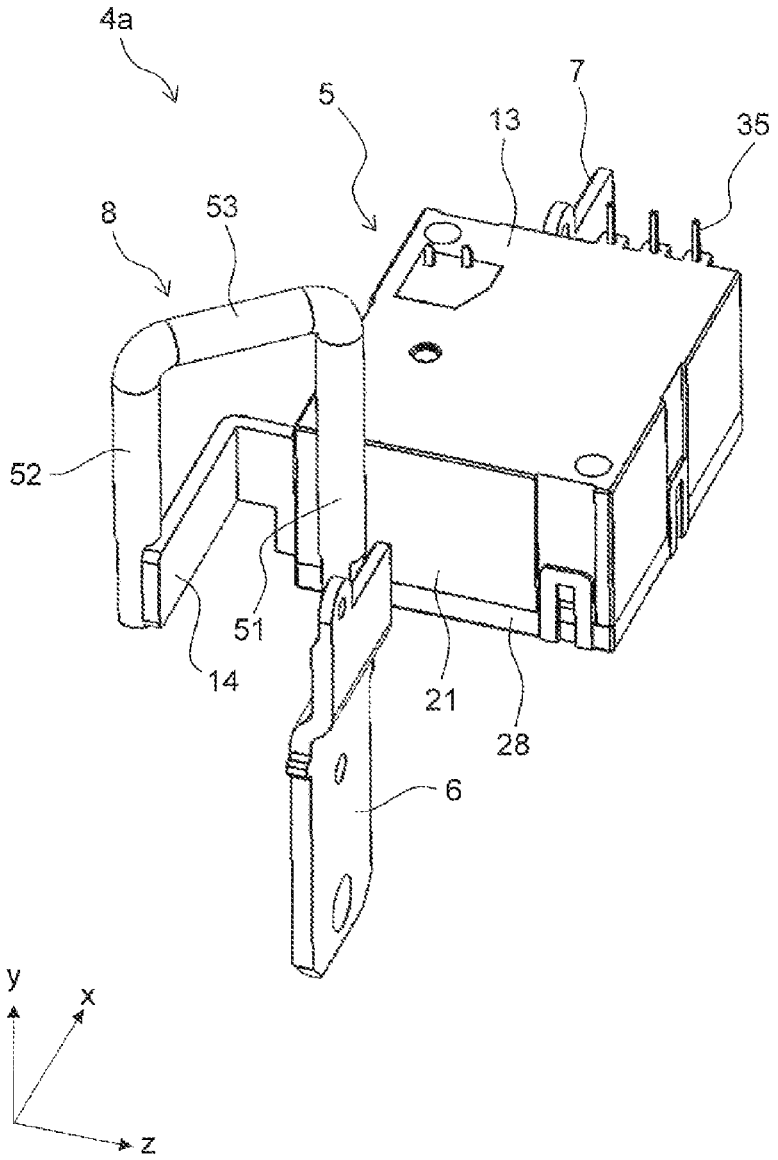
FIG. 3 is a perspective view of a first relay unit according to the first embodiment.

FIGS. 3 and 4 are perspective views of the first relay unit 4*a* according to the first embodiment. As shown in FIGS. 3 and 4, the relay 5 has a relay body 13, a first relay terminal 14, and a second relay terminal 15. The first relay terminal 14 and the second relay terminal 15 protrude from the relay body 13. The first external terminal 6 described above is electrically connected to the first relay terminal 14. The second external terminal 7 is electrically connected to the second relay terminal 15. The first external terminal 6 and the first relay terminal 14 are coupled by the first conductive member 8. The first conductive member 8 is a separate body from the first external terminal 6 and the first relay terminal 14 and fixed to the first external terminal 6 and the first relay terminal 14 by fixing means such as soldering or welding.

As shown in FIG. 2, a current transformer 9 is attached to the first conductive member 8. The current transformer 9 has a substantially cylindrical shape. The current transformer 9 has a through hole 16. A part of the first conductive member 8 is inserted into the through hole 16 of the current transformer 9.

Figure 5:
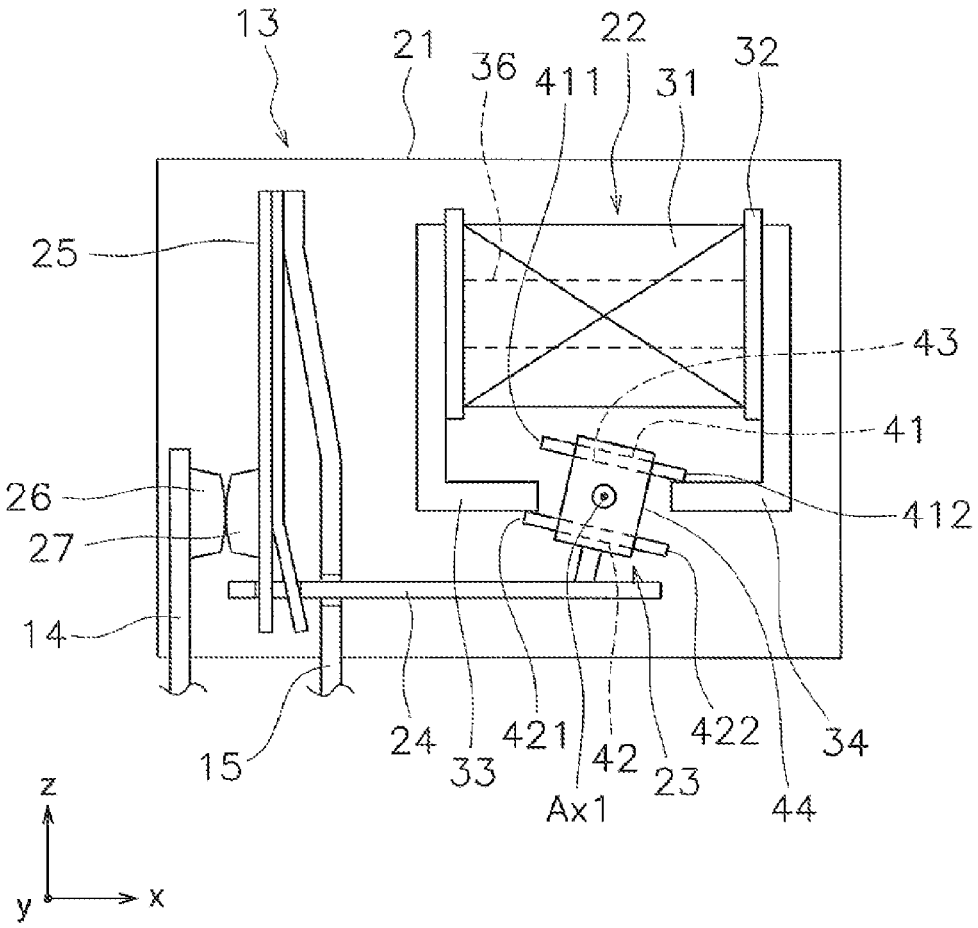
FIG. 5 is a schematic view showing a configuration of the inside of a relay.

FIG. 5 is a schematic view showing a configuration of the inside of the relay 5. As shown in FIG. 5, the relay body 13 has a base 21, a drive unit 22, a movable unit 23, a link member 24, a contact piece 25, a first contact 26, and a second contact 27.

The base 21 accommodates the drive unit 22, the movable unit 23, the link member 24, the contact piece 25, the first contact 26, and the second contact 27. A cover member 28 shown in FIGS. 3 and 4 is attached to the base 21.

The drive unit 22 drives the movable unit 23. The drive unit 22 generates electromagnetic force for rotating the movable unit 23. The drive unit 22 includes a coil 31, a spool 32, a first yoke 33, and a second yoke 34. The coil 31 is wound around the spool 32. A coil terminal 35 shown in FIGS. 3 and 4 is attached to the coil 31. The coil 31 is energized via the coil terminal 35. An iron core 36 is inserted in the spool 32. The first yoke 33 is coupled to one end of the iron core 36. The second yoke 34 is coupled to the other end of the iron core 36. The second yoke 34 is disposed with a space from the first yoke 33.

The movable unit 23 is disposed between the first yoke 33 and the second yoke 34. The movable unit 23 is rotatably supported with respect to the base 21. A rotary shaft Ax1 of the movable unit 23 extends in a direction vertical to the direction in which the first yoke 33 and the second yoke 34 are separated. The movable unit 23 is rotated by the electromagnetic force of the magnetic field generated in the first yoke 33 and the second yoke 34 so as to switch between a contact state and a non-contact state of the first contact 26 and the second contact 27.

The movable unit 23 includes a first armature 41, a second armature 42, a permanent magnet 43, and a movable body 44. The first armature 41, the second armature 42, and the permanent magnet 43 are attached to the movable body 44. The base 21 supports the movable body 44 rotatably around the rotary shaft Ax1.

The first armature 41 includes a first end 411 and a second end 412. The second armature 42 includes a third end 421 and a fourth end 422. The first end 411 and the third end 421 protrude from the movable body 44 in the same direction. The second end 412 and the fourth end 422 protrude from the movable body 44 in the opposite direction to the first end 411 and the third end 421.

The link member 24 couples between the movable body 44 and a contact piece 25. One end of the link member 24 is coupled to the movable body 44. The other end of the link member 24 is coupled to the contact piece 25. The contact piece 25 is disposed facing the second relay terminal 15. One end of the contact piece 25 is connected to the second relay terminal 15. The other end of the contact piece 25 is connected to the link member 24.

The second contact 27 is attached to the contact piece 25. As a result, the second contact 27 is electrically connected to the second relay terminal 15. A first contact 26 is attached to the first relay terminal 14. Thus, the first contact 26 is electrically connected to the first relay terminal 14. The first contact 26 is disposed facing the second contact 27.

Next, the operation of the relay 5 will be described. When the coil 31 is energized in a predetermined direction, electromagnetic force is generated to rotate the movable unit 23 in a forward direction (clockwise in FIG. 5). The movable unit 23 thereby rotates in the forward direction. When the movable unit 23 rotates in the forward direction, the link member 24 moves in the left direction in FIG. 5. Hence the tip of the contact piece 25 moves in the left direction in FIG. 5, and along with this, the second contact 27 moves in such a direction as to approach the first contact 26. As a result, the second contact 27 comes into contact with the first contact 26. As a result, the relay 5 comes into the connected state shown in FIG. 5.

In the connected state, the first end 411 of the first armature 41 is separated from the first yoke 33, and the second end 412 comes into contact with the second yoke 34. The fourth end 422 of the second armature 42 is separated from the second yoke 34, and the third end 421 comes into contact with the first yoke 33. Even when the energization to the coil 31 is stopped in this state, the connected state is kept by the magnetic force of the permanent magnet 43.

Next, when the coil 31 is energized in a reverse direction to the above predetermined direction, electromagnetic force is generated to rotate the movable unit 23 in the reverse direction (counterclockwise in FIG. 5) to the above forward direction. The movable unit 23 thereby rotates in the reverse direction. When the movable unit 23 rotates in the reverse direction, the link member 24 moves in the right direction in FIG. 5. Hence the tip of the contact piece 25 moves in the right direction in FIG. 5, and along with this, the second contact 27 moves in such a direction as to separate from the first contact 26. As a result, the second contact 27 is separated from the first contact 26. As a result, the relay 5 is switched from the connected state to the disconnected state. Even when the energization to the coil 31 is stopped in this state, the disconnected state is kept by the magnetic force of the permanent magnet 43.

Next, the configurations of the first relay terminal 14, the second relay terminal 15, and the first conductive member 8 will be described in detail. In the following description, as shown in FIG. 5, a direction parallel to the direction in which the first yoke 33 and the second yoke 34 are separated is referred to as a first direction (x). A direction parallel to the rotary shaft Ax1 of the movable unit 23 is referred to as a second direction (y). A direction vertical to the first direction (x) and the second direction (y) is referred to as a third direction (z).

Figure 6:
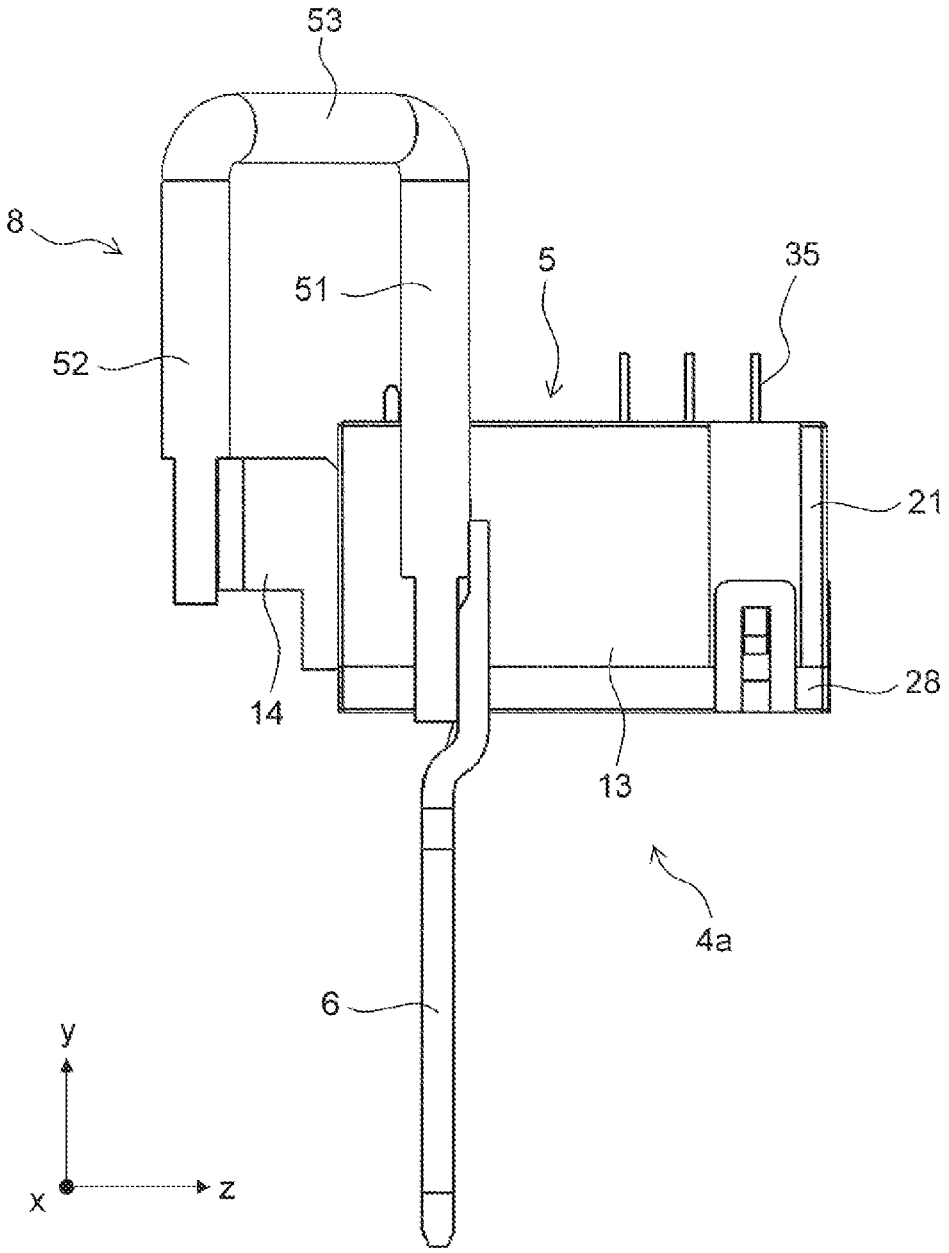
FIG. 6 is a view showing the first relay unit as viewed in a first direction.
Figure 7:
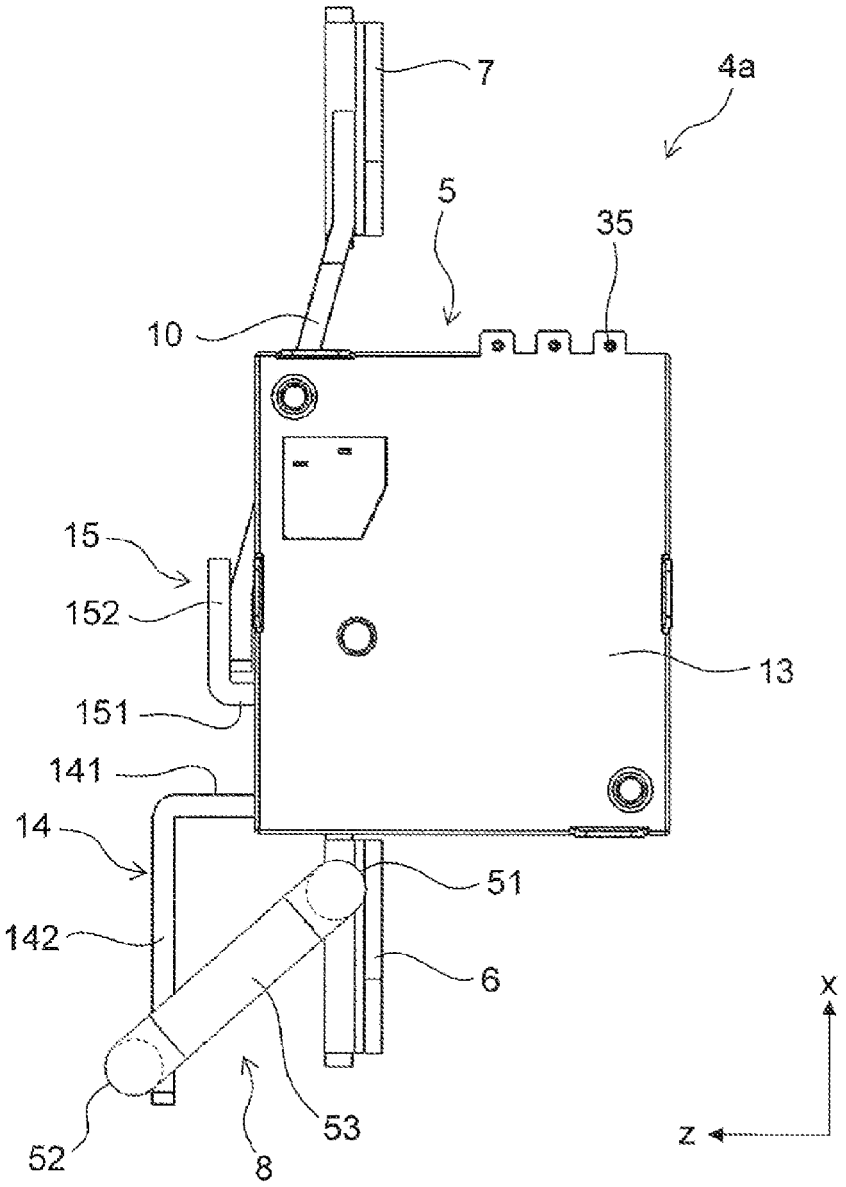
FIG. 7 is a view showing the first relay unit as viewed in a second direction.
Figure 8:
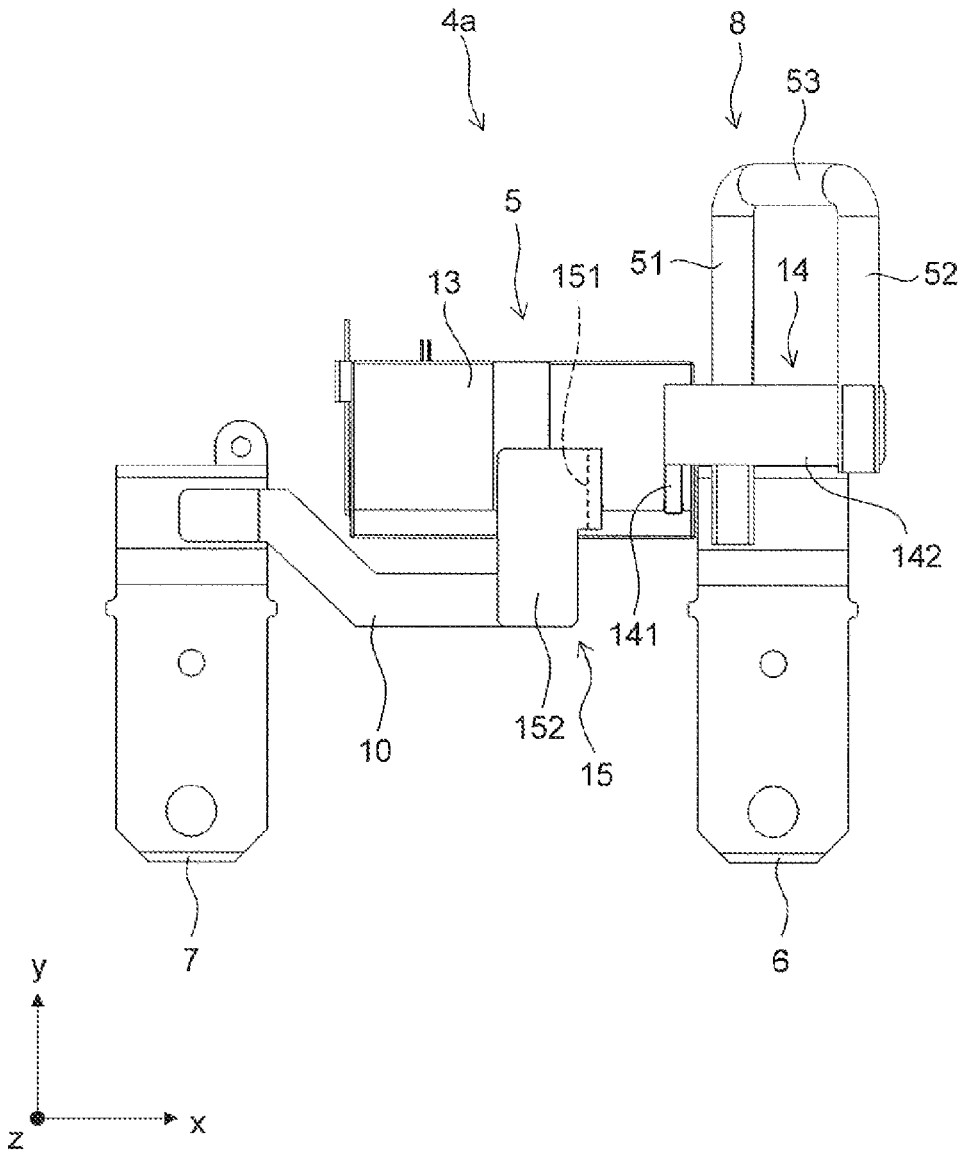
FIG. 8 is a view showing the first relay unit as viewed in a third direction.

FIG. 6 is a view showing the first relay unit 4*a* as viewed in the first direction (x). FIG. 7 is a view showing the first relay unit 4*a* as viewed in the second direction (y). FIG. 8 is a diagram showing the first relay unit 4*a* as viewed in the third direction (z). As shown in FIGS. 3, 4, and 6 to 8, the first conductive member 8 has a U-shaped bent shape. The first conductive member 8 is a rod-like member having a circular cross section. The first conductive member 8 is formed of a metal such as copper, and has a bent shape. The first conductive member 8 includes a first extending portion 51, a second extending portion 52, and a connector 53.

The first extending portion 51 is connected to the first external terminal 6 and extends in the second direction (y). The second extending portion 52 is connected to the first relay terminal 14 and extends in the second direction (y). The connector 53 extends in a direction vertical to the second direction (y), and connects the first extending portion 51 and the second extending portion 52.

As shown in FIG. 6, the first extending portion 51 is disposed at a position overlapping with the relay body 13 as viewed in the first direction (x). The first extending portion 51 extends in the second direction (y) from the first external terminal 6 and extends to a position beyond the relay body 13 in the second direction (y). The current transformer 9 described above is attached to the first extending portion 51. A part of the first extending portion 51 is disposed in the through hole 16 of the current transformer 9.

The second extending portion 52 extends in the second direction (y) from the first relay terminal 14 and extends to a position beyond the relay body 13 in the second direction (y). The second extending portion 52 is disposed at a position not overlapping with the relay body 13 as viewed in the first direction (x). The connector 53 is disposed at a position not overlapping with the relay body 13 as viewed in the first direction (x).

As shown in FIG. 7, the first extending portion 51 and the second extending portion 52 are disposed at positions not overlapping with the relay body 13 as viewed in the second direction (y). The first extending portion 51 is disposed closer to the relay body 13 than the second extending portion 52.

The connector 53 is disposed at a position not overlapping with the relay body 13 as viewed in the second direction (y).

As shown in FIG. 8, as viewed in the third direction (z), the first extending portion 51 and the second extending portion 52 are disposed at positions not overlapping with the relay body 13. The connector 53 is disposed at a position not overlapping with the relay body 13 as viewed in the third direction (z).

As shown in FIG. 7, the first relay terminal 14 has a bent plate shape. The first relay terminal 14 has a first portion 141 and a second portion 142.

The first portion 141 protrudes from the relay body 13. The first portion 141 extends in the third direction (z). The second portion 142 extends in the first direction (x). The second portion 142 is connected to the second extending portion 52.

The second relay terminal 15 has a bent plate shape. The second relay terminal 15 has a first portion 151 and a second portion 152. The first portion 151 protrudes from the relay body 13. The first portion 151 extends in the third direction (z).

The second portion 152 is connected to the first portion 151. As shown in FIG. 8, the second portion 152 extends in the second direction (y).

The second conductive member 10 is a plate-like member. The second conductive member 10 is formed of a metal such as copper. The second conductive member 10 is connected to the second external terminal 7. The second relay terminal 15 is connected to the second portion 152 of the second relay terminal 15. The second conductive member 10 connects the second relay terminal 15 and the second external terminal 7. The second conductive member 10 is a separate body from the second relay terminal 15 and the second external terminal 7 and is fixed to the second relay terminal 15 and the second external terminal 7 by fixing means such as soldering or welding. The second conductive member 10 extends in the first direction (x). As shown in FIG. 8, the second conductive member 10 is disposed at a position not overlapping with the relay body 13 as viewed in the third direction (z).

As shown in FIG. 2, the configurations of the second relay unit 4*b* and the third relay unit 4*c* are the same as those of the first relay unit 4*a*. In FIG. 2, the constituent portions of the second relay unit 4*b* and the third relay unit 4*c* are denoted by the same reference numerals as the corresponding constituent portions of the first relay unit 4*a*.

The first relay unit 4*a*, the second relay unit 4*b*, and the third relay unit 4*c* are disposed side by side between the first opening 11 and the second opening 12. The first relay unit 4*a*, the second relay unit 4*b*, and the third relay unit 4*c* are disposed side by side in the third direction (z). The relay 5 of each of the relay units 4*a*, 4*b*, and 4*c* is disposed such that the rotary shaft Ax1 of the movable unit 23 of each relay 5 is parallel to the extending direction of the first external terminal 6 and the second external terminal 7. The second relay unit 4*b* is disposed in the same direction as the first relay unit 4*a*. The third relay unit 4*c* is disposed so as to be rotated by 180 degrees with respect to the first relay unit 4*a* around the second direction (y).

The first extending portion 51 and the second extending portion 52 of the first conductive member 8 of the first relay unit 4*a* are also disposed at positions not overlapping with the relay body 13 of the second relay unit 4*b* and the relay body 13 of the third relay unit 4*c*, as viewed in the third direction (z). The first extending portion 51 and the second extending portion 52 of the first conductive member 8 of the second relay unit 4*b* are also disposed at positions not overlapping with the relay body 13 of the first relay unit 4*a* and the relay body 13 of the third relay unit 4*c*, as viewed in the third direction (z). The first extending portion 51 and the second extending portion 52 of the first conductive member 8 of the third relay unit 4*c* are also disposed at positions not overlapping with the relay body 13 of the first relay unit 4*a* and the relay body 13 of the second relay unit 4*b*, as viewed in the third direction (z).

In the power switchgear 1 according to the first embodiment described above, the first extending portion 51 extending in the second direction (y) in the first conductive member 8 and the second conductive member 10 are disposed at positions not overlapping with the relay body 13 as viewed in the third direction (z). Accordingly, as compared with the case where the first extending portion 51 and the second conductive member 10 are disposed at positions overlapping with the relay body 13 as viewed in the third direction (z), it is possible to reduce the influence of the magnetic field generated from the first extending portion 51 and the second conductive member 10 on the operation of the relay 5.

Figure 9:
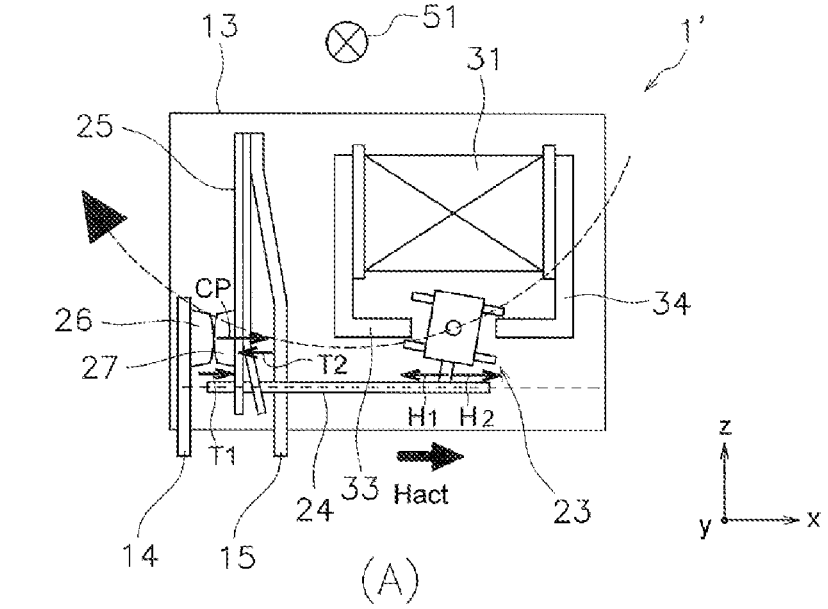
FIGS. 9(A) and 9(B) are schematic views respectively showing a magnetic field generated from a conductive member in the power switchgear according to a first comparative example and the power switchgear according to the first embodiment.
Figure 9:
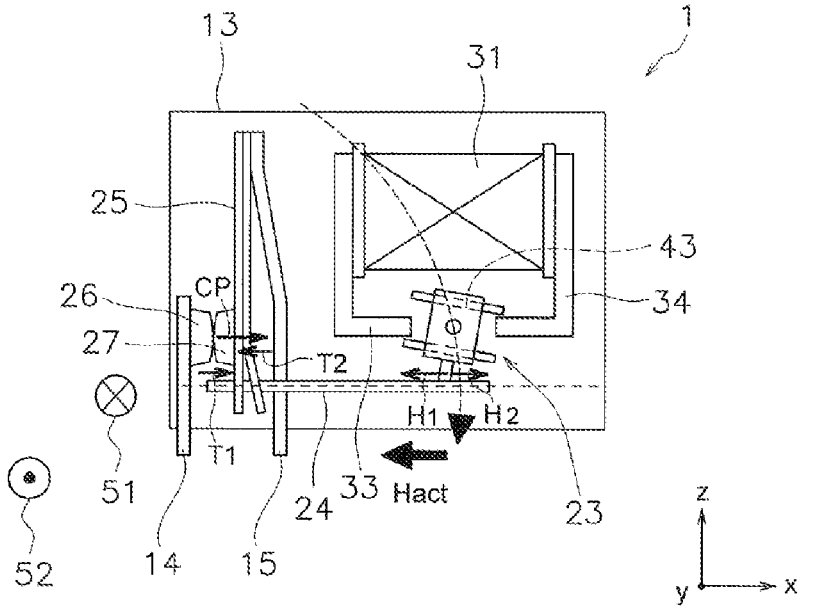

FIGS. 9(A) and 9(B) are schematic views respectively showing a magnetic field generated from the first conductive member 8 in a power switchgear 1' according to a first comparative example and the power switchgear 1 according to the first embodiment.

FIG. 9(A) shows a magnetic field generated by the first conductive member 8 in the power switchgear 1' according to the first comparative example. FIG. 9(B) shows the magnetic field generated by the first conductive member 8 in the power switchgear 1 according to the first embodiment. In the power switchgear 1' and the power switchgear 1, actual holding force Hact acting on the first contact 26 and the second contact 27 is expressed by formula 1 below.

$$Hact = H1 - H2 - CP - T1 + T2 \quad \text{[Formula 1]}$$

H1 is the holding force by the permanent magnet 43. H2 is electromagnetic force generated by the current flowing through the first extending portion 51. CP is contact pressure by the contact piece 25. T1 is electromagnetic repulsive force between the first contact 26 and the second contact 27. T2 is electromagnetic repulsive force between the second relay terminal 15 and the contact piece 25.

As shown in FIG. 9(A), in the power switchgear 1' according to the first comparative example, the first extending portion 51 is disposed at a position overlapping with the relay body 13 as viewed in the third direction (z). In this case, the direction of the magnetic field generated from the first conductive member 8 between the first yoke 33 and the second yoke 34 is close to parallel to the first direction (x). In this case, since the electromagnetic force H2 generated from the first extending portion 51 is large, the actual holding force Hact is a negative value, and acts as force in a direction in which the second contact 27 is separated from the first contact 26 (rightward in FIG. 9(A)). This causes a problem in which the first contact 26 and the second contact 27 are likely to be separated.

On the other hand, in the power switchgear 1 according to the first embodiment, as shown in FIG. 9(B), the first extending portion 51 is located at a position not overlapping with the relay body 13 as viewed in the third direction (z). In this case, the direction of the magnetic field generated from the first conductive member 8 is greatly different from the first direction (x) between the first yoke 33 and the second yoke 34, and close to vertical to the first direction (x). In this case, since electromagnetic force H2 generated from the first extending portion 51 is small, the actual holding force Hact is a positive value, and acts as force in a direction in which the second contact 27 is pressed on the first contact 26 (leftward in FIG. 9(A)). Therefore, it is possible to firmly hold the contact state between the first contact 26 and the second contact 27. Hence it is possible to reduce the influence of the magnetic field generated from the first conductive member 8 on the operation of the relay 5. The same applies to the second conductive member 10.

As shown in FIG. 9(B), in the permanent magnet 43, the first extending portion 51 is preferably disposed such that the direction of the magnetic field generated from the first extending portion 51 is inclined with respect to the third direction (z) rather than being perfectly vertical to the first direction (x). This can reduce the influence of the magnetic field generated from the first extending portion 51 on the permanent magnet 43 of the movable unit 23.

Further, in the present embodiment, not only the first extending portion 51 but also the second extending portion 52 is disposed at a position not overlapping with the relay body 13 as viewed in the third direction (z). That is, all portions included in the first conductive member 8 and extending in the second direction (y) are disposed at positions not overlapping with the relay body 13 as viewed in the third direction (z). Hence it is possible to further reduce the influence of the magnetic field generated from the first conductive member 8 on the operation of the relay 5.

Furthermore, in the present embodiment, all the extending portions 51, 52 included in the first conductive member 8 and the second conductive member 10 of each of the first to third relay units 4*a*, 4*b*, and 4*c* are disposed at positions not overlapping with all the relay bodies 13 of the first to third relay units 4*c*, as viewed in the third direction (z). Hence it is possible to reduce the influence of the magnetic field generated from the first conductive member 8 and the second conductive member 10 of each of the relay units 4*a*, 4*b*, and 4*c* on the operation of the relays 5 of all the relay units 4*a*, 4*b*, and 4*c*.

Figure 10:
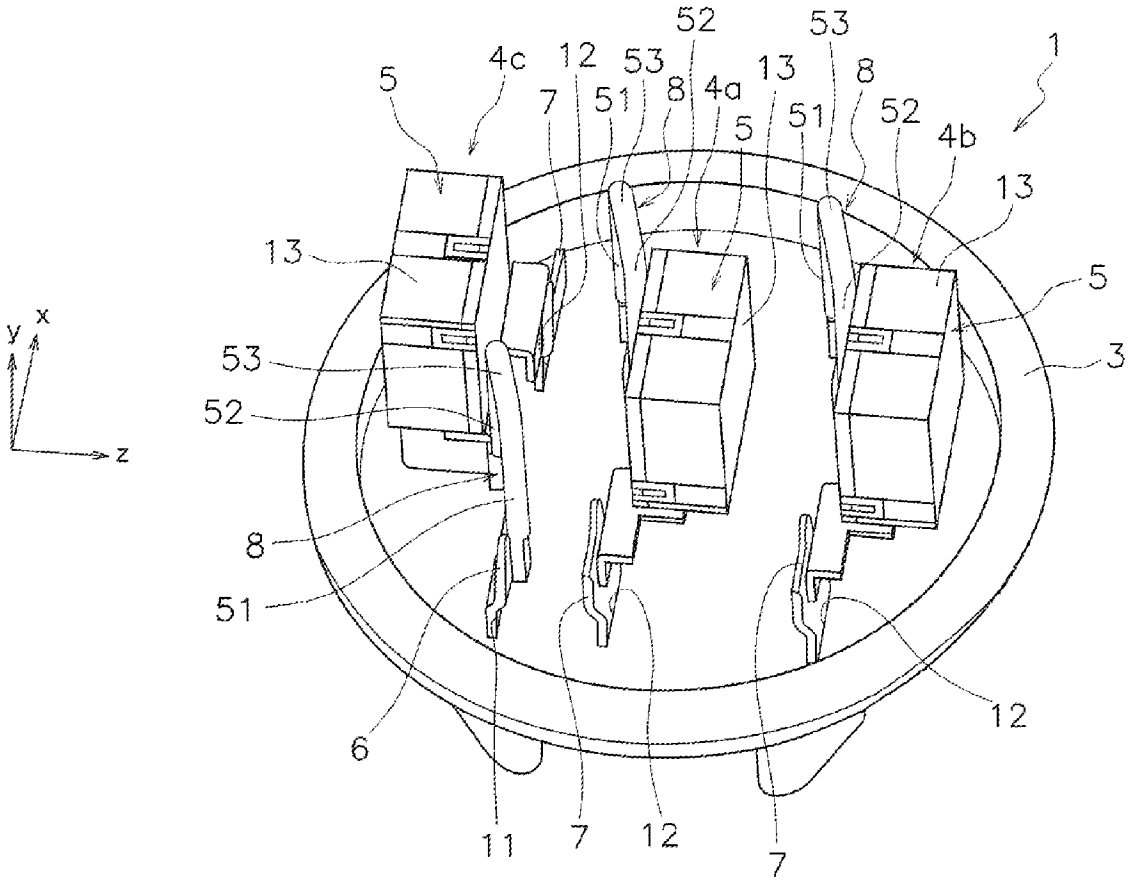
FIG. 10 is a perspective view of a power switchgear according to a second embodiment.

Next, the power switchgear 1 according to the second embodiment will be described. FIG. 10 is a perspective view of the power switchgear 1 according to the second embodiment. As shown in FIG. 10, the power switchgear 1 according to the second embodiment includes a housing 3 and a plurality of relay units 4*a*, 4*b*, and 4*c*. Each of the relay units 4*a*, 4*b*, and 4*c* has the relay 5, the first external terminal 6, the second external terminal 7, the first conductive member 8, and the second conductive member 10 (cf. FIG. 12).

In the power switchgear 1 according to the second embodiment, the relays 5 of the relay units 4*a*, 4*b*, and 4*c* are disposed such that the rotary shaft Ax1 of the movable unit 23 of each relay 5 is disposed so as to be vertical to the direction in which the first external terminal 6 and the second external terminal 7 extend. Other configurations of the relay units 4*a*, 4*b*, and 4*c* are the same as those of the relay units 4*a*, 4*b*, and 4*c* according to the first embodiment, and thus the description thereof will be omitted.

Hereinafter, the configurations of the first relay terminal 14, the second relay terminal 15, the first conductive member 8, and the second conductive member 10 of the relay 5 according to the second embodiment will be described.

In the following description, a direction parallel to the direction in which the first yoke 33 and the second yoke 34 are separated is referred to as a first direction (x). A direction parallel to the rotary shaft Ax1 of the movable unit 23 is referred to as a third direction (z). A direction vertical to the first direction (x) and the third direction (z) is referred to as a second direction (y).

Figure 11:
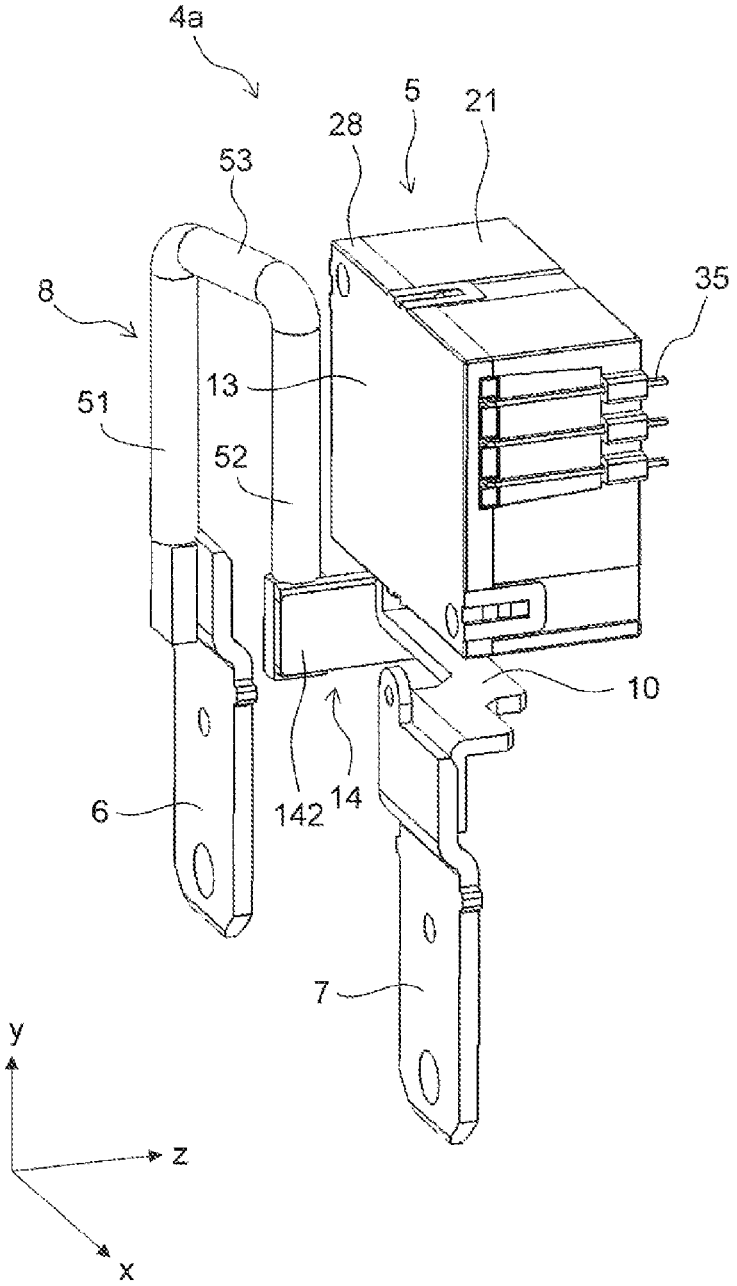
FIG. 11 is a perspective view of a first relay unit according to the second embodiment.
Figure 12:
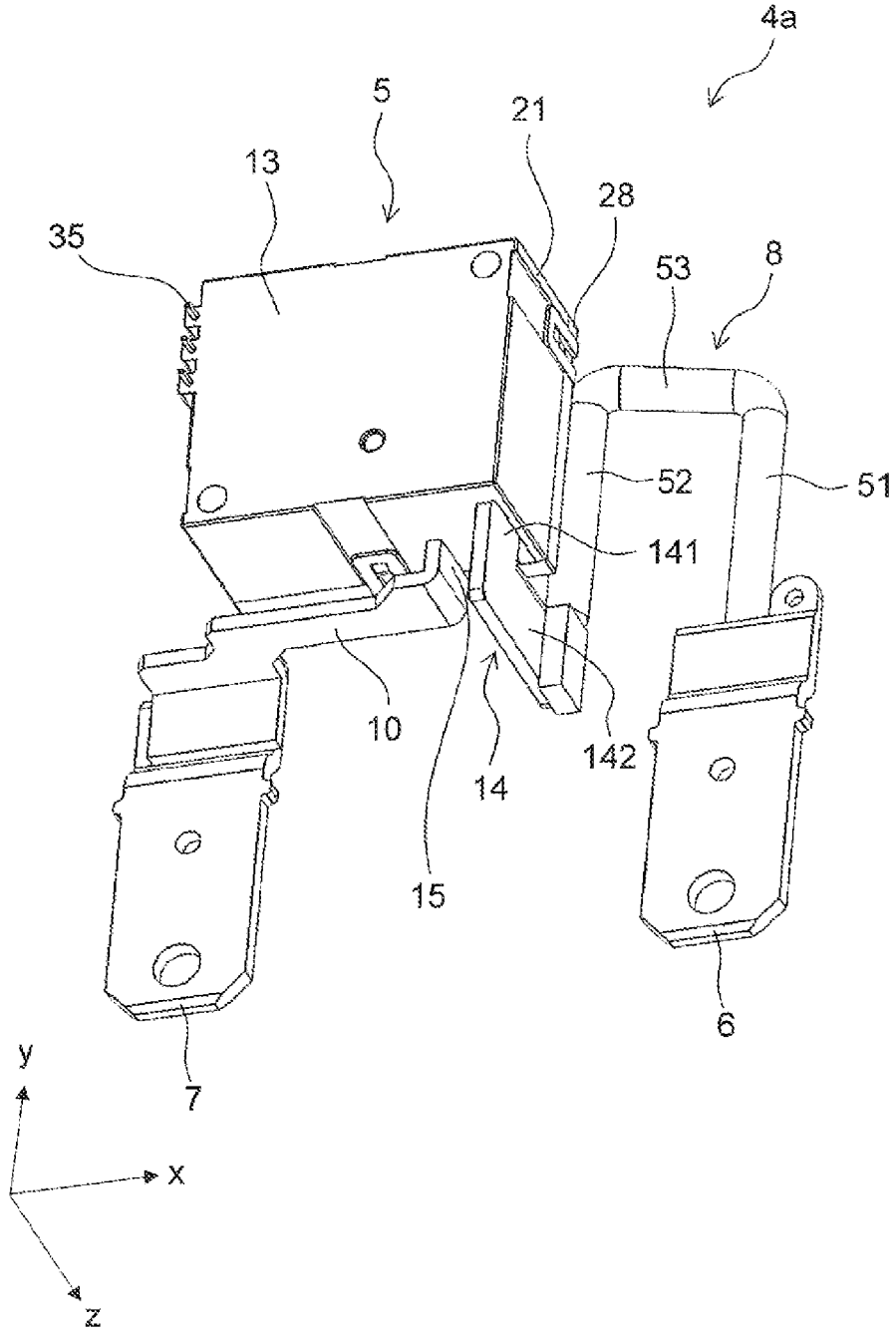
FIG. 12 is a perspective view of the first relay unit according to the second embodiment.
Figure 13:
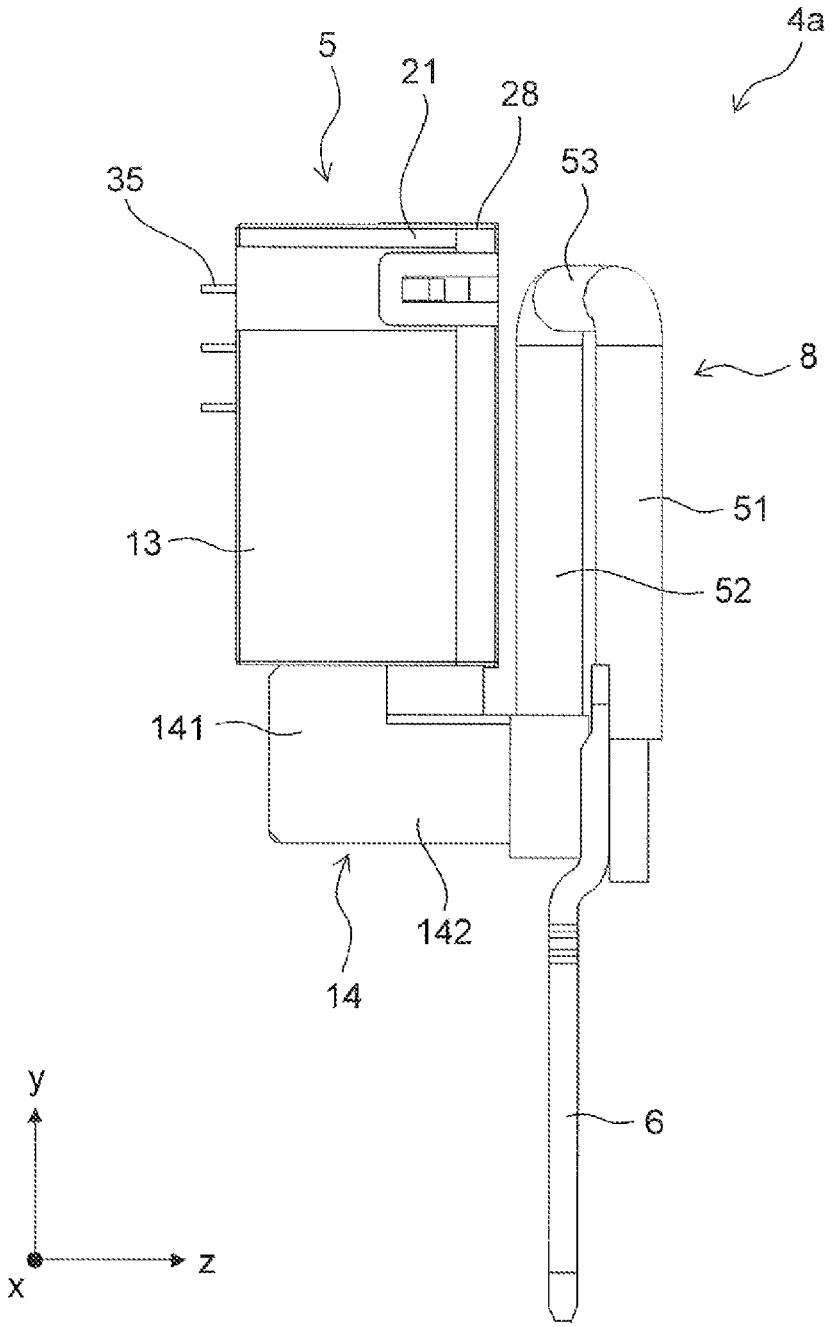
FIG. 13 is a view showing the first relay unit as viewed in the first direction.
Figure 14:
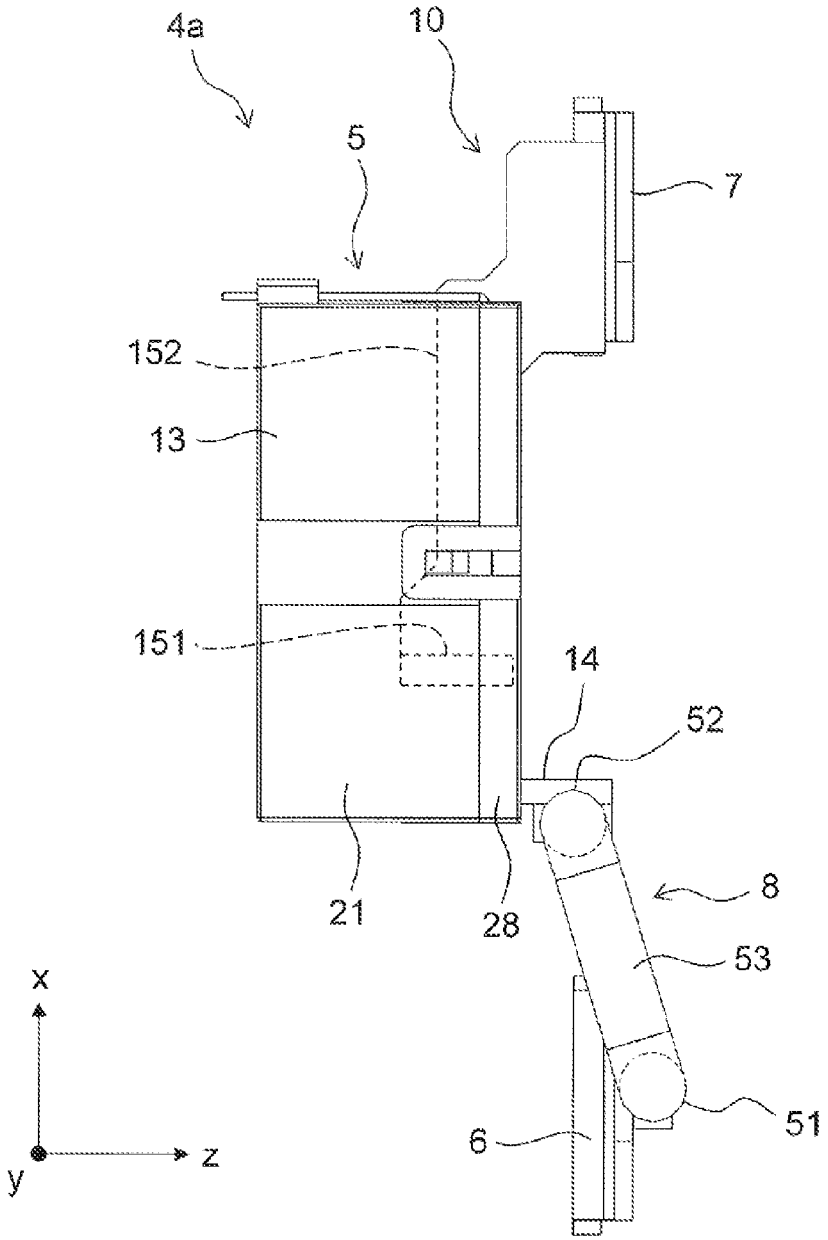
FIG. 14 is a view showing the first relay unit as viewed in the second direction.
Figure 15:
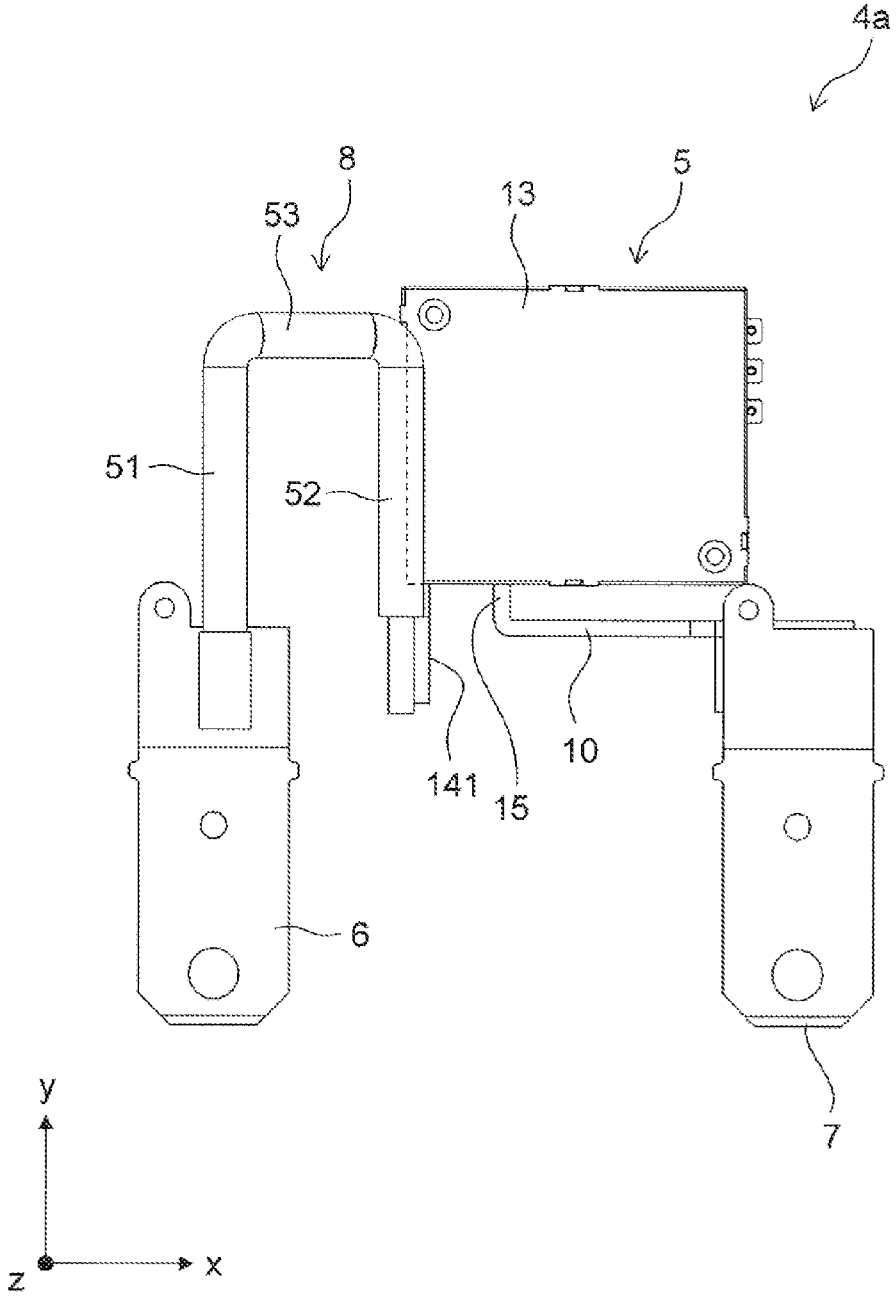
FIG. 15 is a view showing the first relay unit as viewed in the third direction.

FIG. 11 and FIG. 12 are perspective views of the first relay unit 4*a* according to the second embodiment. FIG. 13 is a view showing the first relay unit 4*a* as viewed in the first direction (x). FIG. 14 is a view showing the first relay unit 4*a* as viewed in the second direction (y). FIG. 15 is a view showing the first relay unit 4*a* as viewed in the third direction (z).

The first extending portion 51 is connected to the first external terminal 6 and extends in the second direction (y). The second extending portion 52 is connected to the first relay terminal 14 and extends in the second direction (y). The connector 53 extends in a direction vertical to the second direction (y), and connects the first extending portion 51 and the second extending portion 52.

As shown in FIG. 13, the first extending portion 51 is disposed at a position not overlapping with the relay body 13 as viewed in the first direction (x). Although the current transformer 9 is omitted in FIG. 10, the current transformer 9 described above is attached to the first extending portion 51. The second extending portion 52 is disposed at a position not overlapping with the relay body 13 as viewed in the first direction (x). The connector 53 is disposed at a position not overlapping with the relay body 13 as viewed in the first direction (x).

As shown in FIG. 14, as viewed in the second direction (y), the first extending portion 51 and the second extending portion 52 are disposed at positions not overlapping with the relay body 13. The connector 53 is disposed at a position not overlapping with the relay body 13 as viewed in the second direction (y).

As shown in FIG. 15, the first extending portion 51 is disposed at a position not overlapping with the relay body 13 as viewed in the third direction (z). The second extending portion 52 is disposed at a position overlapping with the relay body 13 as viewed in the third direction (z). However, as viewed in the third direction (z), a part of the second extending portion 52 is disposed at a position overlapping with the relay body 13, and the other portion of the second extending portion 52 is disposed at a position not overlapping with the relay body 13. The connector 53 is disposed at a position not overlapping with the relay body 13 as viewed in the third direction (z).

As shown in FIG. 12, the first relay terminal 14 has a bent plate shape. The first relay terminal 14 has the first portion 141 and the second portion 142.

The first portion 141 protrudes from the relay body 13. The first portion 141 extends in the second direction (y). The second portion 142 is connected to the second extending portion 52. The second portion 142 extends in the third direction (z).

The second relay terminal 15 has a plate-like shape. The second relay terminal 15 protrudes from the relay body 13. The second relay terminal 15 extends in the second direction (y).

The second conductive member 10 is connected to the second external terminal 7. The second conductive member 10 is integrally formed with the second relay terminal 15. The second conductive member 10 extends in the first direction (x). As shown in FIG. 15, the second conductive member 10 is disposed at a position not overlapping with the relay body 13 as viewed in the third direction (z).

As shown in FIG. 10, the configurations of the second relay unit 4*b* and the third relay unit 4*c* are the same as those of the first relay unit 4*a*. The first relay unit 4*a*, the second relay unit 4*b*, and the third relay unit 4*c* are disposed side by side in the third direction (z). The relay 5 of each of the relay units 4*a*, 4*b*, and 4*c* is disposed such that the rotary shaft Ax1 of the movable unit 23 of each relay 5 is vertical to the extending direction of the first external terminal 6 and the second external terminal 7. The second relay unit 4*b* is disposed in the same direction as the first relay unit 4*a*. The third relay unit 4*c* is disposed so as to be rotated by 180 degrees with respect to the first relay unit 4*a* around the second direction (y).

Parts of the first extending portion 51 and the second extending portion 52 of the first conductive member 8 of the first relay unit 4*a* are also disposed at positions not overlapping with the relay body 13 of the second relay unit 4*b* and the relay body 13 of the third relay unit 4*c*, as viewed in the third direction (z). Parts of the first extending portion 51 and the second extending portion 52 of the first conductive member 8 of the second relay unit 4*b* are also disposed at positions not overlapping with the relay body 13 of the first relay unit 4*a* and the relay body 13 of the third relay unit 4*c*, as viewed in the third direction (z). Parts of the first extending portion 51 and the second extending portion 52 of the first conductive member 8 of the third relay unit 4*c* are also disposed at positions not overlapping with the relay body 13 of the first relay unit 4*a* and the relay body 13 of the second relay unit 4*b*, as viewed in the third direction (z).

In the power switchgear 1 according to the second embodiment described above, the first extending portion 51 extending in the second direction (y) in the first conductive member 8 and the second conductive member 10 are disposed at positions not overlapping with the relay body 13 as viewed in the third direction (z). Accordingly, as compared with the case where the first extending portion 51 and the second conductive member 10 are disposed at positions overlapping with the relay body 13 as viewed in the third direction (z), it is possible to reduce the influence of the magnetic field generated from the first extending portion 51 on the operation of the relay 5.

Figure 16:
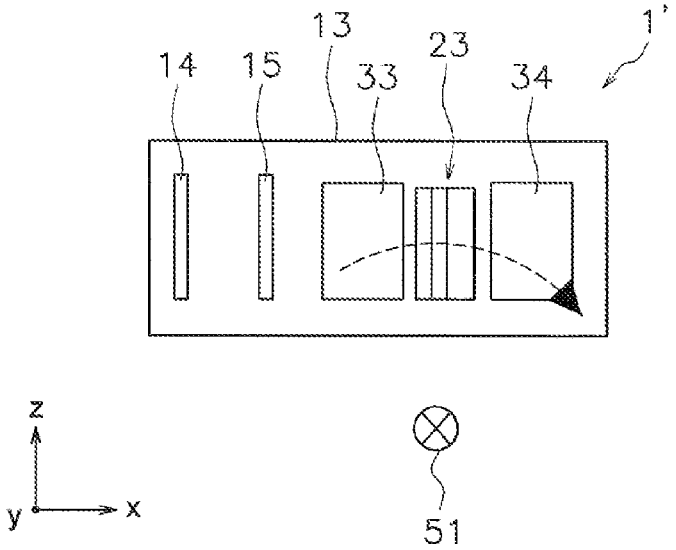
FIGS. 16(A) and 16(B) are schematic views respectively showing a magnetic field generated from a conductive member in the power switchgear according to a second comparative example and the power switchgear according to the second embodiment.
Figure 16:
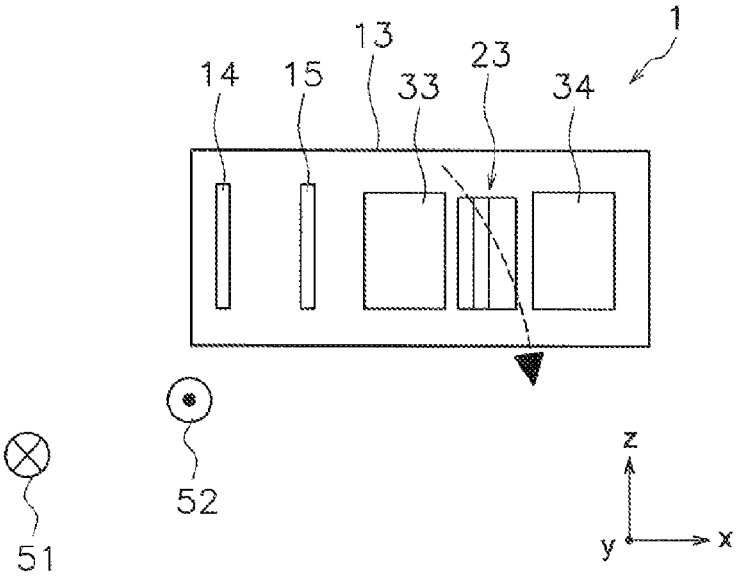

FIGS. 16(A) and 16(B) are schematic views respectively showing a magnetic field generated from the first conductive member 8 in the power switchgear 1' according to the second comparative example and the power switchgear 1 according to the second embodiment. FIG. 16(A) shows the magnetic field generated from the first conductive member 8 in the power switchgear 1' according to the second comparative example. FIG. 16(B) shows the magnetic field generated by the first conductive member 8 in the power switchgear 1 according to the second embodiment.

As shown in FIG. 16(A), in the power switchgear 1' according to the second comparative example, the first extending portion 51 is disposed at a position overlapping with the relay body 13 as viewed in the third direction (z). In this case, the direction of the magnetic field generated from the first conductive member 8 between the first yoke 33 and the second yoke 34 is close to parallel to the first direction (x). This causes a problem in which the first contact 26 and the second contact 27 are likely to be separated, similarly to the first comparative example described above.

On the other hand, in the power switchgear 1 according to the second embodiment, as shown in FIG. 16(B), the first extending portion 51 is located at a position not overlapping with the relay body 13 as viewed in the third direction (z). In this case, the direction of the magnetic field generated from the first conductive member 8 is greatly different from the first direction (x) between the first yoke 33 and the second yoke 34, and close to vertical to the first direction (x). Thus, similarly to the first embodiment, it is possible to firmly hold the contact state between the first contact 26 and the second contact 27. Hence it is possible to reduce the influence of the magnetic field generated from the first extending portion 51 on the operation of the relay 5. The same applies to the second conductive member 10.

Further, in the present embodiment, a part of the second extending portion 52 is disposed at a position not overlapping with the relay body 13 as viewed in the third direction (z). Therefore, as compared with the case where the entire second extending portion 52 is disposed at a position overlapping with the relay body 13 as viewed in the third direction (z), it is possible to reduce the influence of the magnetic field generated from the second extending portion 52 on the operation of the relay 5.

Furthermore, all the first extending portions 51 included in the first conductive members 8 and the second conductive members 10 of the first to third relay units 4*a*, 4*b*, and 4*c* are disposed at positions not overlapping with all the relay bodies 13 of the first to third relay units 4*a*, 4*b*, and 4*c*, as viewed in the third direction (z). Hence it is possible to reduce the influence of the magnetic field generated from the first conductive members 8 and the second conductive members 10 of the relay units 4*a*, 4*b*, and 4*c* on the operation of all the relays 5.

Although embodiments of the present invention have been described in the above, the present invention is not limited to the above embodiments, and a variety of changes can be made in the scope not deviating from the gist of the present invention.

In the above embodiment, the number of relays 5 of the power switchgear 1 is three, but it may be less than three. Alternatively, the number of relays 5 of the power switchgear 1 may be more than three. The power switchgear 1 is not limited to a smart meter, but may be mounted on another device for switching electric power.

The shape of the housing 3 is not limited to a circular shape but may be other shapes such as a quadrilateral shape. The placement of the relays 5 is not limited to those of the above embodiments but may be changed. The placement of the first and second external terminals 6 and 7 is not limited to those of the above embodiments, but may be changed.

The structure of the first relay terminal 14 or the second relay terminal 15 is not limited to those of the above embodiments but may be changed. The structures of the first conductive member 8 and the second conductive member 10 are not limited to those of the embodiments described above, but may be changed. For example, the first conductive member 8 may be integrally formed with the first relay terminal 14. The second conductive member 10 may be integrally formed with the second relay terminal 15. Alternatively, the first conductive member 8 may be integrally formed with the first external terminal 6. The second conductive member 10 may be formed integrally with the second external terminal 7.

The cross section of the first conductive member 8 is not limited to a circular shape but may be polygonal. The first conductive member 8 may be a plate-like member. The current transformer 9 is not necessarily attached to the first conductive member 8. The second conductive member 10 may be a rod-like member.

The extending portion does not necessarily extend perfectly "vertically" to the first direction (x) but may extend in a direction slightly deviated from the perfect "vertical" direction. Similarly, the first relay terminal 14 and the second relay terminal 15 do not necessarily extend perfectly "vertically" to a certain direction but may extend in a direction slightly deviated from the perfect "vertical" direction. The first relay terminal 14 or the second relay terminal 15 does not necessarily extend in a certain direction but may extend in a direction slightly deviated from the certain direction.

Figure 17:
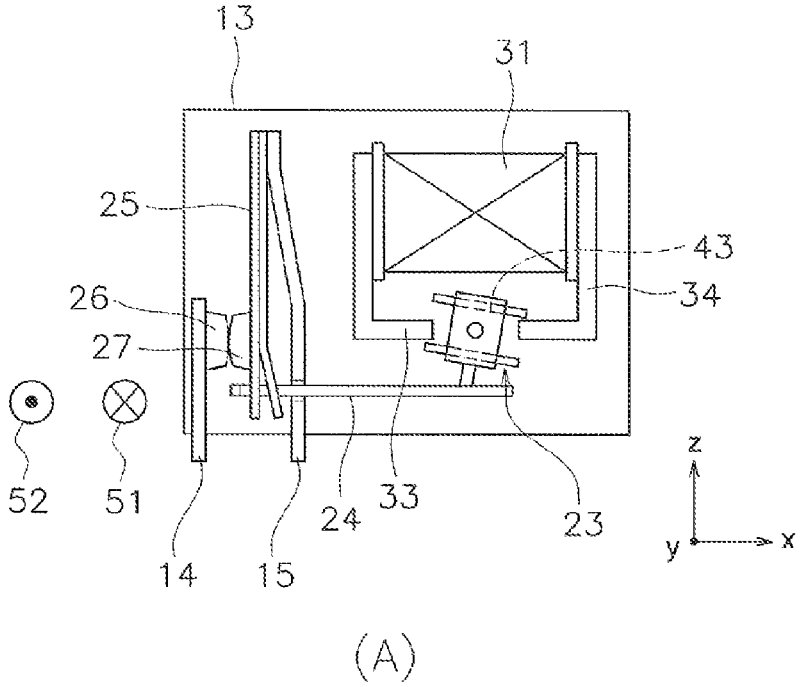
FIGS. 17(A) and 17(B) are schematic views respectively showing placement of a first extending portion and a second extending portion according to a first modification and a second modification of the first embodiment.
Figure 17:
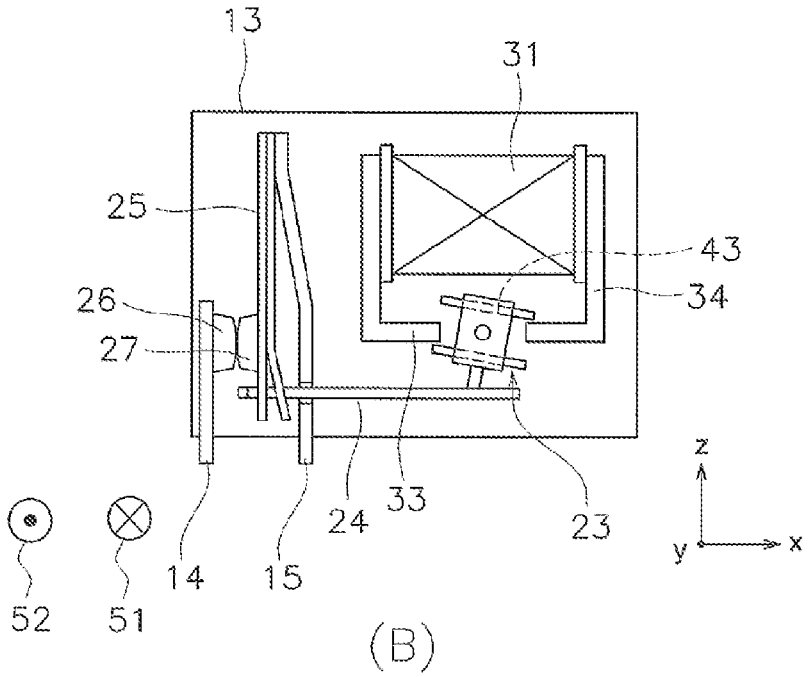

The placement of the first extending portion 51 or the second extending portion 52 is not limited to those of the above embodiments but may be changed. For example, FIG. 17(A) is a schematic view showing the placement of the first extending portion 51 and the second extending portion 52 according to a first modification of the first embodiment. As shown in FIG. 17(A), both the first extending portion 51 and the second extending portion 52 may be disposed at positions not overlapping with the relay 5 as viewed in the third direction (z) but overlapping with the relay 5 as viewed in the first direction (x).

FIG. 17(B) is a schematic view showing the placement of the first extending portion 51 and the second extending portion 52 according to a second modification of the first embodiment. As shown in FIG. 17(B), both the first extending portion 51 and the second extending portion 52 may be disposed at positions not overlapping with the relay 5 as viewed in the third direction (z) and the first direction (x).

Figure 18:
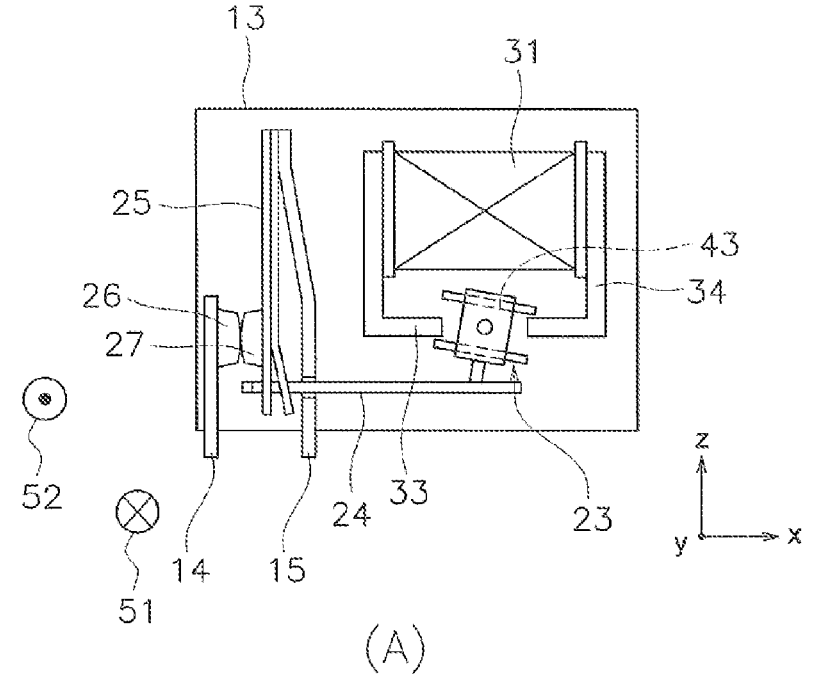
FIGS. 18(A) and 18(B) are schematic views respectively showing placement of a first extending portion and a second extending portion according to a third modification and a fourth modification of the first embodiment.
Figure 18:
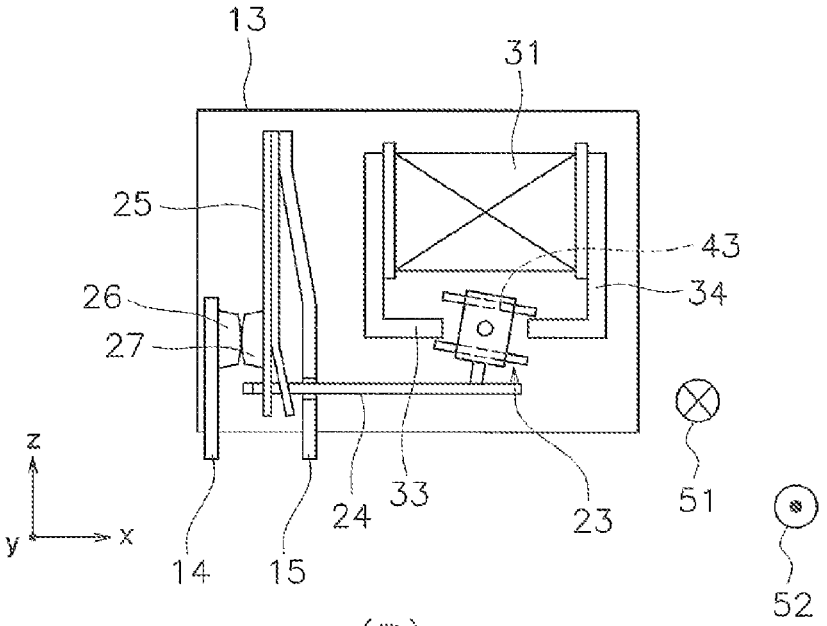

FIG. 18(A) is a schematic view showing the placement of the first extending portion 51 and the second extending portion 52 according to a third modification of the first embodiment. As shown in FIG. 18(A), the first extending portion 51 may be disposed at a position not overlapping with the relay 5 as viewed in the third direction (z) and the first direction (x). The second extending portion 52 may be disposed at a position not overlapping with the relay 5 as viewed in the third direction (z) but overlapping with the relay 5 as viewed in the first direction (x).

FIG. 18(B) is a schematic view showing the placement of the first extending portion 51 and the second extending portion 52 according to a fourth modification of the first embodiment. As shown in FIG. 18(B), the first extending portion 51 and the second extending portion 52 may be disposed at positions opposite to the first extending portion 51 and the second extending portion 52 in the first embodiment. Similarly, the first extending portion 51 and the second extending portion 52 may be disposed at positions opposite to the first extending portion 51 and the second extending portion 52 according to the first to third modifications of the first embodiment.

Figure 19:
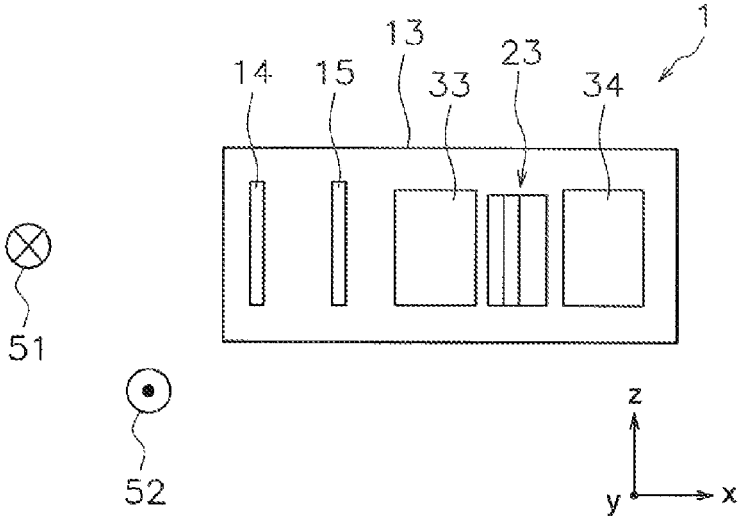
FIGS. 19(A) and 19(B) are schematic views respectively showing placement of a first extending portion and a second extending portion according to a first modification and a second modification of the second embodiment.
Figure 19:
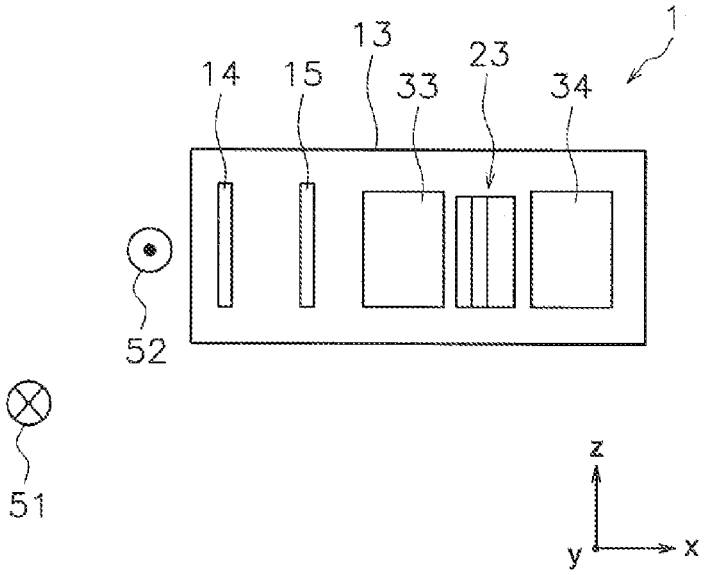

FIG. 19(A) is a schematic view showing the placement of the first extending portion 51 and the second extending portion 52 according to a first modification of the second embodiment. As shown in FIG. 19(A), the first extending portion 51 may be disposed at a position not overlapping with the relay 5 as viewed in the third direction (z) but overlapping with the relay 5 as viewed in the first direction (x). The second extending portion 52 may be disposed at a position not overlapping with the relay 5 as viewed in the third direction (z) and the first direction (x).

FIG. 19(B) is a schematic view showing the placement of the first extending portion 51 and the second extending portion 52 according to a second modification of the second embodiment. As shown in FIG. 19(B), the first extending portion 51 may be disposed at a position not overlapping with the relay 5 as viewed in the third direction (z) and the first direction (x). The second extending portion 52 may be disposed at a position not overlapping with the relay 5 as viewed in the third direction (z) but overlapping with the relay 5 as viewed in the first direction (x).

Figure 20:
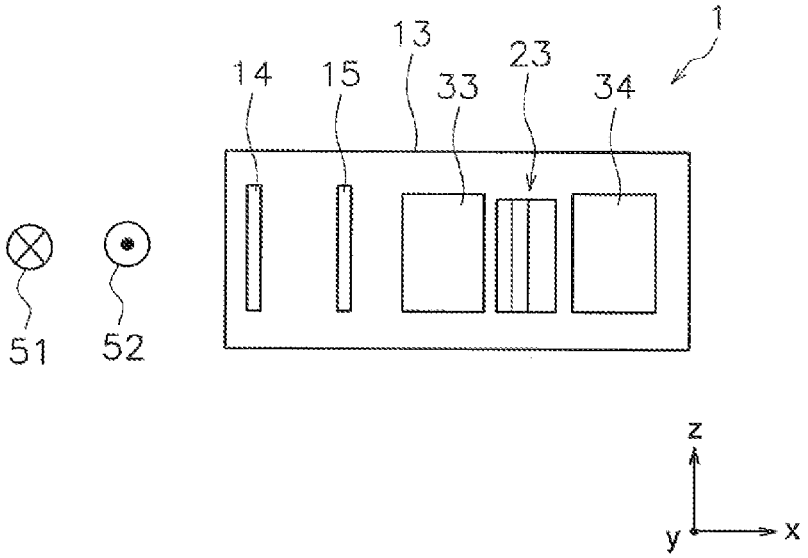
FIGS. 20(A) and 20(B) are schematic views respectively showing placement of a first extending portion and a second extending portion according to a third modification and a fourth modification of the second embodiment.
Figure 20:
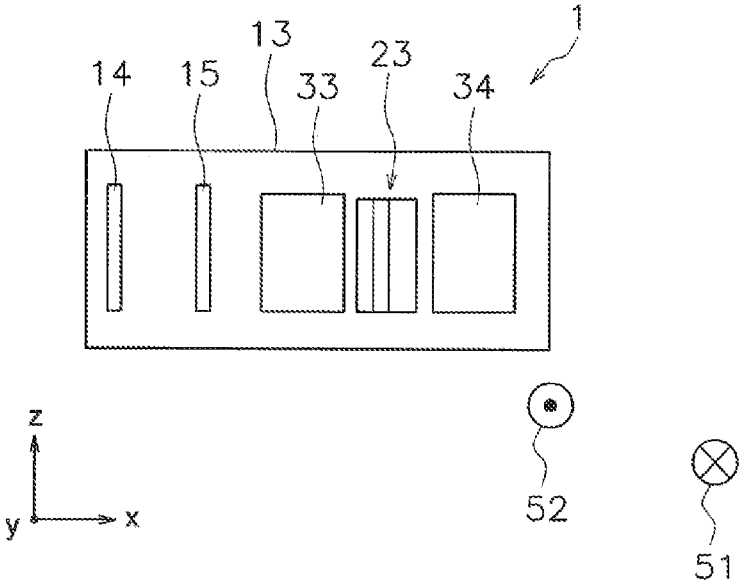

FIG. 20(A) is a schematic view showing the placement of the first extending portion 51 and the second extending portion 52 according to a third modification of the second embodiment. As shown in FIG. 20(A), both the first extending portion 51 and the second extending portion 52 may be disposed at positions not overlapping with the relay 5 as viewed in the third direction (z) but overlapping with the relay 5 as viewed in the first direction (x).

As in the first to third modifications of the second embodiment, when the first extending portion 51 or the second extending portion 52 is disposed at a position overlapping with the relay 5 as viewed in the first direction (x), the first extending portion 51 or the second extending portion 52 is preferably disposed at a position close to the center of the first yoke 33 and the second yoke 34 in the third direction (z). Accordingly, as compared with the case where the first extending portion 51 or the second extending portion 52 is disposed at a position far from the center of the first yoke 33 and the second yoke 34 in the third direction (z), the direction of the magnetic field from the first extending portion 51 or the second extending portion 52 between the first yoke 33 and the second yoke 34 can be brought close to vertical to the first direction (x). Hence it is possible to further reduce the influence on the relay 5 by the magnetic field from the first extending portion 51 or the second extending portion 52.

FIG. 20(B) is a schematic view showing the placement of the first extending portion 51 and the second extending portion 52 according to a fourth modification of the second embodiment. As shown in FIG. 20(B), the first extending portion 51 and the second extending portion 52 may be disposed at opposite positions to the first extending portion 51 and the second extending portion 52 in the second embodiment. Similarly, the first extending portion 51 and the second extending portion 52 may be disposed at positions opposite to the first extending portion 51 and the second extending portion 52 according to the first to third modifications of the second embodiment.

INDUSTRIAL APPLICABILITY

According to the present invention, it is possible to reduce the influence of the magnetic field generated from the conductive member on the operation of the relay in the power switchgear.

DESCRIPTION OF SYMBOLS

13 relay body
14 first relay terminal
15 second relay terminal
5 relay
6 first external terminal
7 second external terminal
8 first conductive member
10 second conductive member
26 first contact
27 second contact
31 coil
36 iron core
33 first yoke
34 second yoke
23 movable unit
1 power switchgear
51 first extending portion
52 second extending portion
53 connector
43 permanent magnet
9 current transformer
3 housing

The invention claimed is:

1. A power switchgear, comprising:

a relay including a relay body, and a first relay terminal and a second relay terminal protruding from the relay body;

a first external terminal electrically connected to the first relay terminal;

a second external terminal electrically connected to the second relay terminal;

a first conductive member coupling the first external terminal and the first relay terminal; and a second conductive member coupling the second external terminal and the second relay terminal, wherein the relay body includes a first contact electrically connected to the first relay terminal, a second contact electrically connected to the second relay terminal, a coil, an iron core inserted in the coil, a first yoke connected to one end of the iron core, a second yoke connected to the other end of the iron core and disposed with a space in a predetermined first direction (x) with respect to the first yoke, and a movable unit disposed between the first yoke and the second yoke, and rotated by electromagnetic force from the first yoke and the second yoke to switch between a contact state and a non-contact state of the first contact and the second contact, the first conductive member has an extending portion extending in a second direction (y) orthogonal to the first direction (x), and the extending portion and the second conductive member are disposed at positions not overlapping with the relay body as viewed in a third direction (z) orthogonal to the first direction (x) and the second direction (y).

2. The power switchgear according to claim 1, wherein the extending portion is disposed at a position overlapping with the relay body as viewed in the first direction (x).

3. A power switchgear according to claim 1, wherein the extending portion comprises:

a first extending portion connected to the first external terminal and extending in a second direction (y) orthogonal to the first direction (x), and a second extending portion connected to the first relay terminal and extending in the second direction (y), the first conductive member comprises a connector connecting the first extending portion and the second extending portion, and at least one of the first extending portion and the second extending portion is disposed at a position not overlapping with the relay body as viewed in a third direction (z) orthogonal to the first direction (x) and the second direction (y).

4. The power switchgear according to claim 3, wherein both the first extending portion and the second extending portion are disposed at positions not overlapping with the relay body as viewed in the third direction (z).

5. The power switchgear according to claim 3, wherein at least one of the first extending portion and the second extending portion is disposed at a position overlapping with the relay body as viewed in the first direction (x).

6. The power switchgear according to claim 5, wherein both the first extending portion and the second extending portion are disposed at positions overlapping with the relay body as viewed in the first direction (x).

7. The power switchgear according to claim 1, wherein a rotary shaft of the movable unit extends in the second direction (y).

8. The power switchgear according to claim 7, wherein the movable unit includes a permanent magnet, and in the permanent magnet, the extending portion is disposed such that a direction of a magnetic field generated by a current flowing through the extending portion is inclined with respect to the third direction (z).

9. The power switchgear according to claim 1, wherein a rotary shaft of the movable unit extends in the third direction (z).

10. The power switchgear according to claim 1, wherein all portions included in the first conductive member and extending in the second direction (y) are disposed at positions not overlapping with the relay body as viewed in the third direction (z).

11. The power switchgear according to claim 1, further comprising:

a current transformer attached to the extending portion.

12. The power switchgear according to claim 1, wherein the extending portion has a circular cross section.

13. The power switchgear according to claim 1, comprising:

a housing, and a plurality of the relays disposed on the housing, wherein the extending portion is disposed at a position not overlapping with all the relay bodies of the plurality of the relays as viewed in the third direction (z).

14. The power switchgear according to claim 1, comprising:

a housing; and a plurality of the relays disposed on the housing, wherein all portions included in the first conductive member of each of the plurality of the relays and extending in the second direction (y) are disposed at positions not overlapping with the relay bodies of all the plurality of the relays as viewed in the third direction (z).

* * * * *